US010448713B1

(12) United States Patent
Gavin

(10) Patent No.: US 10,448,713 B1
(45) Date of Patent: Oct. 22, 2019

(54) EMERALD-CUT DIAMOND

(71) Applicant: Brian Steven Gavin, Houston, TX (US)

(72) Inventor: Brian Steven Gavin, Houston, TX (US)

( * ) Notice: Subject to any disclaimer, the term of this patent is extended or adjusted under 35 U.S.C. 154(b) by 7 days.

(21) Appl. No.: 15/662,843

(22) Filed: Jul. 28, 2017

(51) Int. Cl.
*A44C 17/00* (2006.01)

(52) U.S. Cl.
CPC ..... *A44C 17/001* (2013.01); *A44C 17/007* (2013.01)

(58) Field of Classification Search
None
See application file for complete search history.

(56) References Cited

U.S. PATENT DOCUMENTS 3,796,065 A 3/1974 Watermeyer
5,657,646 A * 8/1997 Rosenberg ..... A44C 17/001 63/32
6,474,102 B1 * 11/2002 Buerger ..... A44C 17/001 63/32
7,336,347 B2 2/2008 Sasian et al.
7,355,683 B2 4/2008 Sasian et al.
7,382,445 B2 6/2008 Sasian et al.
7,420,657 B2 9/2008 Sasian et al.
8,098,369 B2 1/2012 Sasian et al.
2009/0056374 A1 * 3/2009 Abate ..... A44C 17/001 63/26
2012/0180525 A1 * 7/2012 Weingarten ..... A44C 17/001 63/32
2013/0019636 A1 * 1/2013 Rydlewicz ..... A44C 17/001 63/32
2013/0298605 A1 * 11/2013 Ritchie ..... B28D 5/00 63/32
2013/0319045 A1 * 12/2013 Ritchie ..... A44C 17/001 63/32
2016/0120274 A1 * 5/2016 Mezhibovsky ..... A44C 17/001 63/32

OTHER PUBLICATIONS

AGS Guidelines, https://www.americangemsociety.org/Content/uploads/1pt1_14.
AGS Guidelines, https://www.americangemsociety.org/Content/uploads/1pt2_14.

(Continued)

*Primary Examiner* — Emily M Morgan
(74) *Attorney, Agent, or Firm* — Daniel N. Lundeen; Lundeen & Lundeen PLLC

(57) ABSTRACT

Emerald-cut diamond with length/width of 1.35 to 1.40; table of 55 to 60 percent; corner ratio of 13.5 to 14.5 percent; girdle thickness up to 3 percent; crown main angle of 28 to 45 degrees; first crown break angle of 2 to 6 degrees; second crown break angle of 2 to 6 degrees; pavilion main angle of 43 to 48 degrees; first pavilion break angle of 2 to 5 degrees; and second pavilion break angle of 2 to 5 degrees. Diamonds cut in accordance with these parameters may have light performance 0-grade domains on a grade map with wide crown and pavilion mains ranges. A method cuts the diamond according to the parameters, and may include selecting crown and pavilion main angles from the map, and cutting the diamond sufficiently close to the selected cutting parameters to obtain the light performance grade of 0.

13 Claims, 20 Drawing Sheets
(8 of 20 Drawing Sheet(s) Filed in Color)

(56) References Cited

OTHER PUBLICATIONS

AGS Guidelines, https://www.americangemsociety.org/Content/uploads/1pt3_14.
AGS Guidelines, https://www.americangemsociety.org/Content/uploads/1pt4_14.
AGS Guidelines, https://www.americangemsociety.org/Content/uploads/1pt4_18.
Duncan Miller, FACETIPS A Simple Emerald Cut, May 9, 2019 available at [[http://]] ctminsoc.org.za/articles/facetips-a-simple-emerald-cut.
Yantzer, Peter et al., "Foundation, Research Results and Application of the New AGS Cut Grading System", American Gem Society (2005) published at https://www.americangemsociety.org/Content/uploads/85441435072031.pdf.

* cited by examiner

EMERALD-CUT DIAMOND

FIELD OF THE INVENTION

This application is directed to symmetrical emerald-cut diamonds cut for maximum light performance.

BACKGROUND

The emerald-cut diamond has aesthetics and visual qualities that make it preferable to brilliant-cut diamonds for certain applications or buyers. There are many angles and dimensions that can be selected by the stone cutter to achieve the desired emerald cut. Commonly, cutters select parameters to maximize stone weight and, usually to a lesser priority, minimizing the deductions for the cut and/or light performance defects. Thus, the popular emerald-cut parameters have been standardized for maximizing stone weight, and as a result it can be difficult to obtain good light performance under these guidelines.

The symmetrical emerald cut is exemplified according to embodiments of the present invention in FIGS. 1, 2, 3A, and 3B, which show a crown C and pavilion P above and below a girdle G. The crown C has a number of steps called "tiers" designated, e.g., as crown first tier C1, crown second tier C2, crown third tier C3, and possibly one or more additional crown tiers (not shown) as well as a table T. Similarly, the pavilion P may have a pavilion first tier P1, pavilion second tier P2, pavilion third tier P3 (FIGS. 1, 2, 3A), and possibly a fourth tier P4 (FIG. 3B), or more additional pavilion tiers (not shown) that terminate at an edge or culet CT. Three (FIGS. 1, 2, 3A), and to a lesser extent four (FIG. 3B), pavilion tiers are common. The first tiers C1, P1 adjacent the girdle G are also referred to as the crown or pavilion main facets, or simply as "mains." FIG. 3B is a side sectional view of an emerald cut dismond with a 4-tier pavilion The cut also has a variable ratio of length L to width W, both measured at the girdle, that can vary from 1 for square and octagonal emerald cuts, to a higher ratio for rectangular emerald cuts, and a variable corner ratio CR, i.e., the ratio of the corner width to the width W, as measured along the width W. High L/W ratios define a generally rectangular stone that is elongated, whereas a low L/W close to 1 will have a squarer appearance. Similarly, high corner ratios CR produce a more octagonal stone, whereas a low CR is more square or rectangular.

Other dimensions include the ratio or percentage of the width $W_T$ of the table T to the width W of the stone at the girdle, often called the "table percentage"; the overall depth of the stone or the depth of the crown C or pavilion P, reported as a percentage of the width W; and the height of the girdle G, which is also given as a percentage of the width W.

The widths of the crown tiers C1, C2, C3, and so on are normally substantially equivalent, as are the widths of the pavilion tiers P1, P2, P3, P4, and so on. The angles of these facets are normally given as the angle with respect to the table T. Often the angles of each of the tiers is given, and sometimes the crown and pavilion mains C1, P1 are given along with the differences in the angles or "breaks" between the adjacent tiers. E.g., a stone with crown angles for C1, C2, C3 of 35°, 28°, 21° may be referred to as having a 35° crown main angle and crown breaks of 7° (T1 to T2) and 7° (T2 to T3), or in shorthand as simply 7-7; while a stone with pavilion angles for P1, P2, P3 of 54°, 43°, 36° may be referred to as having a 54° pavilion main angle and pavilion breaks of 11° (P1 to P2) and 7.5° (P2 to P3), or in shorthand as simply 11-7.5.

Emerald-cut diamonds are typically cut for visual appearance of the stone shape and maximum stone weight, and thus the crown and pavilion main angles C1, P1 may be relatively steep, the breaks large, the table percentages ($100W_T/W$) high, etc. The popular parameters have been developed more or less along these lines, and different cutters have their own preferences. For example, some jewelers may provide general cut guidelines such as the following:

TABLE 1

Typical Emerald-cut Guidelines

| Rating: | Excellent | Very Good | Good | Fair | Poor |
|---|---|---|---|---|---|
| Table (% W) | 61-69 | 57-60 or 70-72 | 54-56 or 73-74 | 51-53 or 75-79 | <51 or >79 |
| Depth (% W) | 61-67 | 59-60.9 or 67.1-70 | 57-58.9 or 70.1-74 | 54-56.9 or 74.1-79 | <54 or >79 |
| Girdle | V. Thin-S. Thick | | Thick | V. Thick | Ex. Thin or Ex. Thick |
| Culet | None | V. Small | Small | Medium | >Medium |
| L/W - Rectangle | 1.4-1.5 | 1.30-1.39 or 1.51-1.60 | 1.20-1.29 or 1.61-1.80 | 1.15-1.19 or 1.81-1.90 | <1.15 or >1.90 |

More recently, it has been possible to take light performance into account. For example, in 2004 the American Gem Society Laboratories ("AGSL" or "AGS") developed the angular spectrum evaluation tool (ASET®) imaging disclosed in U.S. Pat. No. 7,355,683, hereby incorporated herein by reference, as a way to determine how a diamond is handling and returning light to the observer. ASET images are generated by illuminating the diamond with green light from the sides in the upper hemisphere up to 45 degrees from the horizontal plane of the table facet, representing low-intensity light from an indirect source; red light from above at 45 to 75 degrees from horizontal, representing the brightest, high-intensity light; and blue light from above at 75 to 90 degrees, representing areas of obstruction, i.e., light that the diamond cannot take in due to the body of the observer, which the viewer sees as contrast. Using ASET imaging, the AGS can mathematically calculate the light performance grade for a virtual diamond with a given set of proportions, e.g., the cutter can confirm that the proportions proposed for cutting the diamond should obtain an AGS light performance grade of 0, i.e., light performance deductions equal to or less than 0.5. The procedure is described in Yantzer, Peter et al., "Foundation, Research Results and Application of the New AGS Cut Grading System", American Gem Society (2005), published at cdn.ymaws.com/www.americangemsociety.org/resource/resmgr/docs/AG- SLab/AGS-Cut-System.pdf. Using ASET imaging, as well as ray tracing and virtual diamond modeling software, for some popular cuts and conventional facet angles, the AGS have developed ASET grade maps that show the theoretical light performance deductions or grades for virtual diamonds with perfect polish and symmetry, as a function of the various facet angles that can be selected by the cutter.

In using these maps, however, the process for planning and executing the cutting of a diamond may take the final weight of the diamond into account as a primary target, and thus the diamantaire seeking a high light performance may frequently select the steepest angles and largest depths possible, or sacrifice light performance for a heavier stone.

Even with these tools and light performance as a primary objective, however, it can be difficult to obtain an emerald-cut with the better light performance grades (AGS 0 or 1). For starters, both the polish and symmetry of the facets must be Ideal (AGS) or at least Excellent (AGS). Then, the facet angles that achieve the AGS 0 or 1 grades must be selected, and the diamond cut and polished according to the selected parameters. For example, the AGS has determined the combinations for emerald-cut stones with common crown breaks of 7-7 and common pavilion breaks of 11-7.5 over a range of L/W ratios, corner ratios, table percentages, crown main angles, and pavilion main angles, that are needed to obtain Ideal cut proportions for maximum light return or brilliance. AGS has made available the results in the Emerald Cut Guidelines (2006), published at americangemsociety.org/page/emeraldguidelines. Unfortunately, many of the 0-grade combinations of crown and pavilion mains shown on these emerald-cut maps are isolated from combinations of similar crown and pavilion angles, meaning that the cutter has limited flexibility in the selection of angles, and the angles must be cut very precisely to obtain the best light performance grades.

For example, FIG. 4 shows a portion of the grade map for an old time emerald-cut with crown breaks of 5.5-2.5 and pavilion breaks of 11.5-4.5 for pavilion mains from 51.0-55.0 and crown mains of 39.0-41.0. It is seen that the 0-grade crown/pavilion mains combination domains are not continuous and a 0 grade will not obtain unless the crown and/or pavilion mains are precisely within ranges of 0.5 to 1.0 degrees, i.e., pavilion mains 53.5-54.5 for crown main of 39.0-39.5 degrees, or crown main of 40.0-41.0 for pavilion main of 53.5. The corresponding ASET image for the old time emerald-cut of FIG. 4 for combination 100 of a crown main angle of 40.0 and a pavilion main angle of 53.5 is seen in FIG. 5.

As additional examples, similarly isolated "island" areas of 0-grade domains are seen in FIGS. 6 and 7 for the AGS emerald-cut guidelines for tables of 55% (FIG. 6) and 60% (FIG. 7), L/W ratio of 1.4, corner ratio of 14%, crown breaks 7-7, pavilion breaks 11-7, and 3% girdles.

What is needed is a set of emerald-cut parameters that can more easily obtain Excellent and/or Ideal light performance over wider, more continuous ranges of crown and pavilion main angle combinations, and/or that would give the cutter more flexibility in the selection, and/or leeway in the accuracy, of the angles or other cutting parameters.

SUMMARY OF THE INVENTION

The present invention in one aspect provides parameters for cutting an emerald-cut diamond. In an embodiment, the parameters may facilitate achievement of an AGS grade of 1 or 0 for light performance. In an embodiment, the parameters may comprise wide ranges of crown and pavilion mains in relatively large 0-grade domains on grade maps of light performance deductions.

In an embodiment, an emerald-cut diamond comprises a ratio of length to width of from about 1.35 to 1.40; a table having a width of from about 55 to 60 percent; a girdle thickness up to about j percent; a crown main facet tier adjacent the girdle having an angle of from about 28 to 45 degrees; a first crown break angle between the crown main tier and an adjacent crown second tier from about 2 to 6 degrees; a second crown break angle between the crown second tier and an adjacent crown third tier from about 2 to 6 degrees; a pavilion main facet tier adjacent the girdle having an angle with respect to the table plane of from about 43 to 48 degrees; a first pavilion break angle between the pavilion main tier and an adjacent pavilion second tier from about 3 to 5 degrees; and/or a second pavilion break angle between the pavilion second tier and an adjacent pavilion third tier from about 2 to 5 degrees. The emerald-cut diamond may have an AGS light performance grade of 1 or preferably 0. The corner ratio is preferably from about 13.5 to 14.5 percent, more preferably about 14.0 percent.

In another aspect, the present invention provides a method for cutting an emerald-cut diamond with Excellent, preferably Ideal light performance characteristics. The method may allow selection of crown and pavilion main angles from a relatively wide range that may facilitate achieving a light performance grade of 1 or preferably 0, for example. By selecting from within these parameters in a 1- or preferably 0-grade domain area of an ASET map, the cutter has improved flexibility for the selection, and greater forgiveness in deviations from the selected parameters during cutting, to obtain an emerald-cut diamond with a light performance grade of 1, or preferably 0, for example.

In one embodiment, a method for cutting an emerald-cut diamond comprises cutting the diamond with a ratio of length to width of from about 1.35 to 1.40; forming corners on the diamond; forming a table on the crown of the diamond having a width of from about 55 to 60 percent; forming a thickness of the girdle up to about 3 percent; forming a crown main facet tier adjacent the girdle having an angle of from about 28 to 45 degrees; forming a crown second tier facet adjacent the crown main facet tier having a first crown break angle between the crown main and second tiers from about 3 to 5 degrees; forming a crown third tier facet adjacent the second crown tier facet having a second crown break angle between the crown second and third tiers from about 3 to 6 degrees; forming a pavilion main facet tier adjacent the girdle having an angle with respect to the table plane of from about 43 to 48 degrees; forming a pavilion second tier facet adjacent the pavilion main facet tier having a first pavilion break angle between the pavilion main and second tiers from about 2 to 6 degrees; and forming a pavilion third tier facet adjacent the pavilion second tier facet having a second pavilion break angle between the pavilion second and third tiers from about 2 to 6 degrees. In an embodiment, the diamond may comprise an Excellent polish and symmetry, preferably Ideal polish and symmetry. Preferably, the corners have a corner ratio of from about 13.5 to 14.5 percent.

In another embodiment, the method may further comprise selecting the ratio of length to width, the corner ratio, the table percentage, first and second crown break angles, first and second pavilion break angles, and ranges of the crown main angle and pavilion main angle corresponding to a grade map of light performance deductions for combinations of the crown and pavilion main angles over said ranges; selecting cutting parameters comprising crown and pavilion main angles from the grade map corresponding to a 1-grade domain, preferably a 0-grade domain; and cutting the diamond sufficiently close to the selected cutting parameters, preferably within 0.25 degrees of each of the selected crown and pavilion main tier and first and second break angles, to obtain a light performance grade of 1, preferably a light performance grade of 0.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

In the following description and claims, the diamond components, angles, lengths, widths, thicknesses, grades, etc., are determined in accordance with the American Gem Society Laboratories ("AGS") definitions and standards in effect on the filing date of this application. Percentages and ratios are based on the width of the diamond measured at the girdle ("girdle width"), unless otherwise indicated.

As used herein and in the claims, light performance grades and components thereof are determined in accordance with the AGS grading standards in effect on the filing date of this application. The AGS grades are determined by evaluating deductions from perfect or Ideal (AGS) and rounded to the nearest whole number, e.g., a stone with deductions of 0.49 would be assigned an AGS 0-grade, while a stone with deductions of 1.51 would be assigned an AGS grade of 2. Thus, the lower the grade, the better the light performance. Unless otherwise indicated, as used herein "grade" refers to the AGS light performance grade.

"Grade map" as used herein is any tool that provides light performance deductions or grades as a function of one or more cutting parameters. The maps may be in the form of charts or tables as in the AGS Cutting Chart Guidelines mentioned above, or may be a mathematical model.

Figure 4:
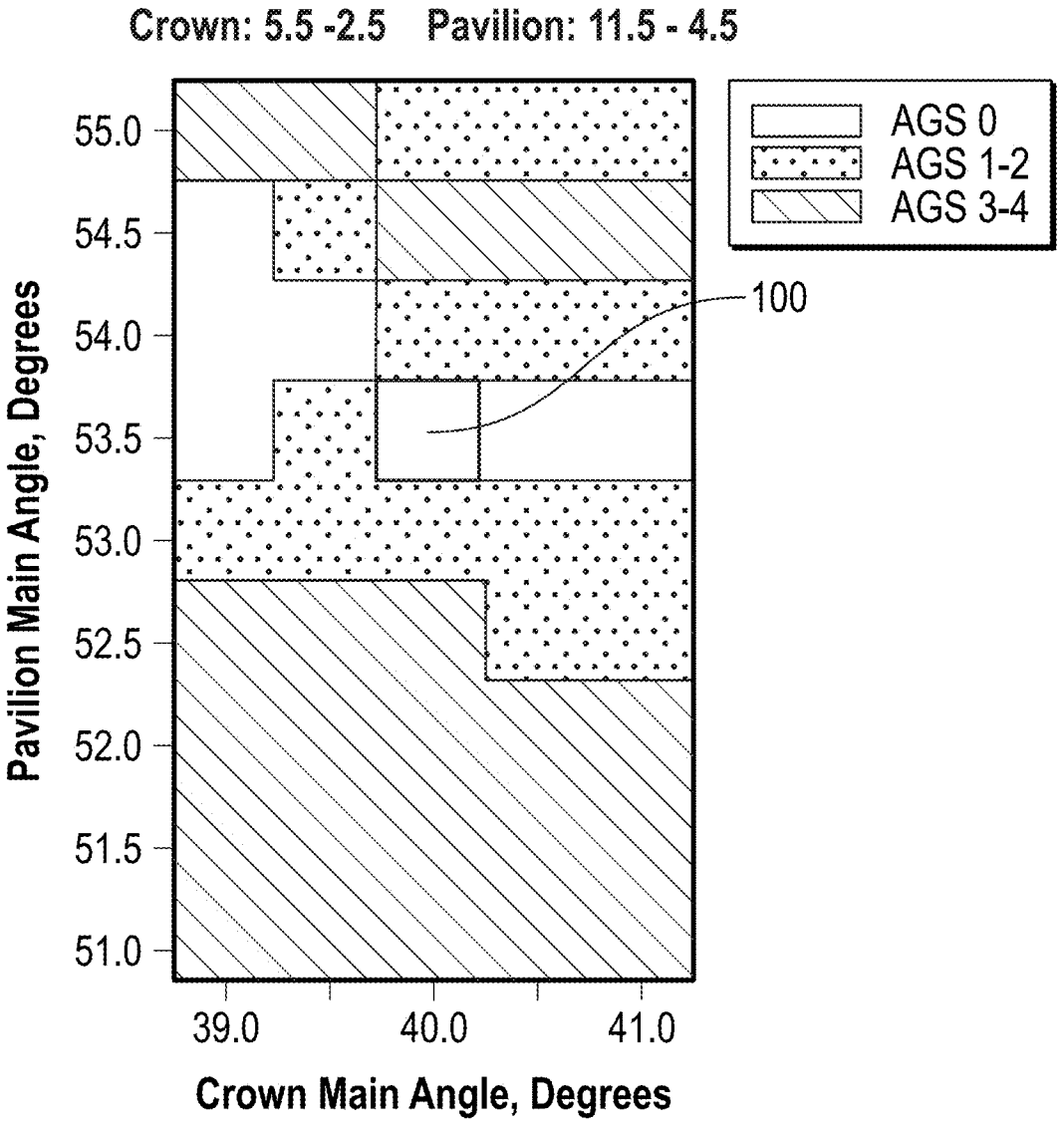
FIG. 4 (Prior Art)
FIG. 4 is a map of the light performance grades of an emerald-cut diamond according to the "old time" parameters with an L/W ratio of 1.4, corner ratio of 0.14, a table % of 55, crown breaks of 5.5-2.5 and pavilion breaks of 11.5-4.5 over ranges of crown main angles of 39-41 and pavilion main angles of 51-55.
Figure 5:
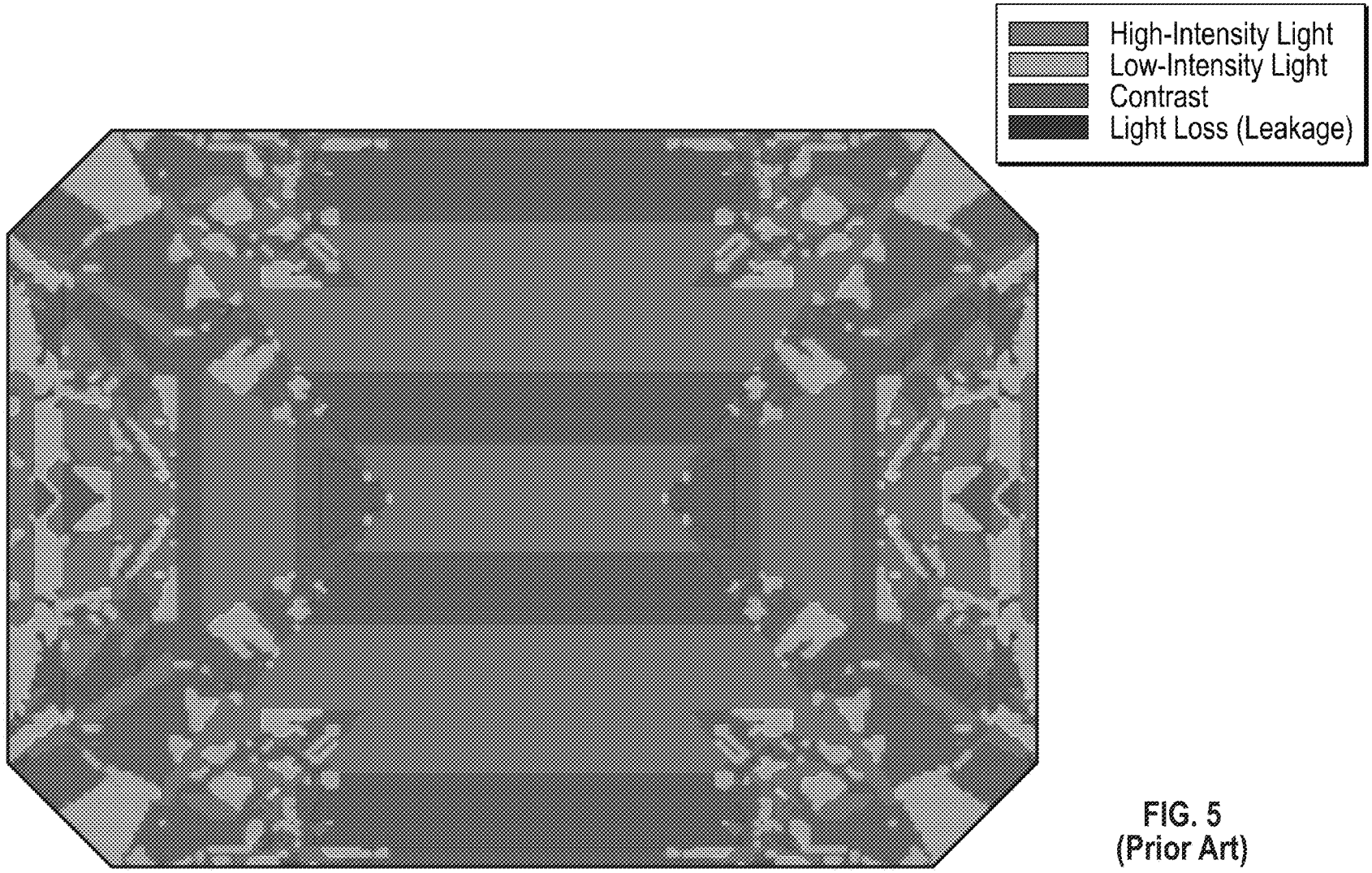
FIG. 5 (Prior Art)
FIG. 5 is an ASET image of the old time emerald-cut diamond of FIG. 4 for a crown main angle of 40 and a pavilion main angle of 53.5.
Figure 6:
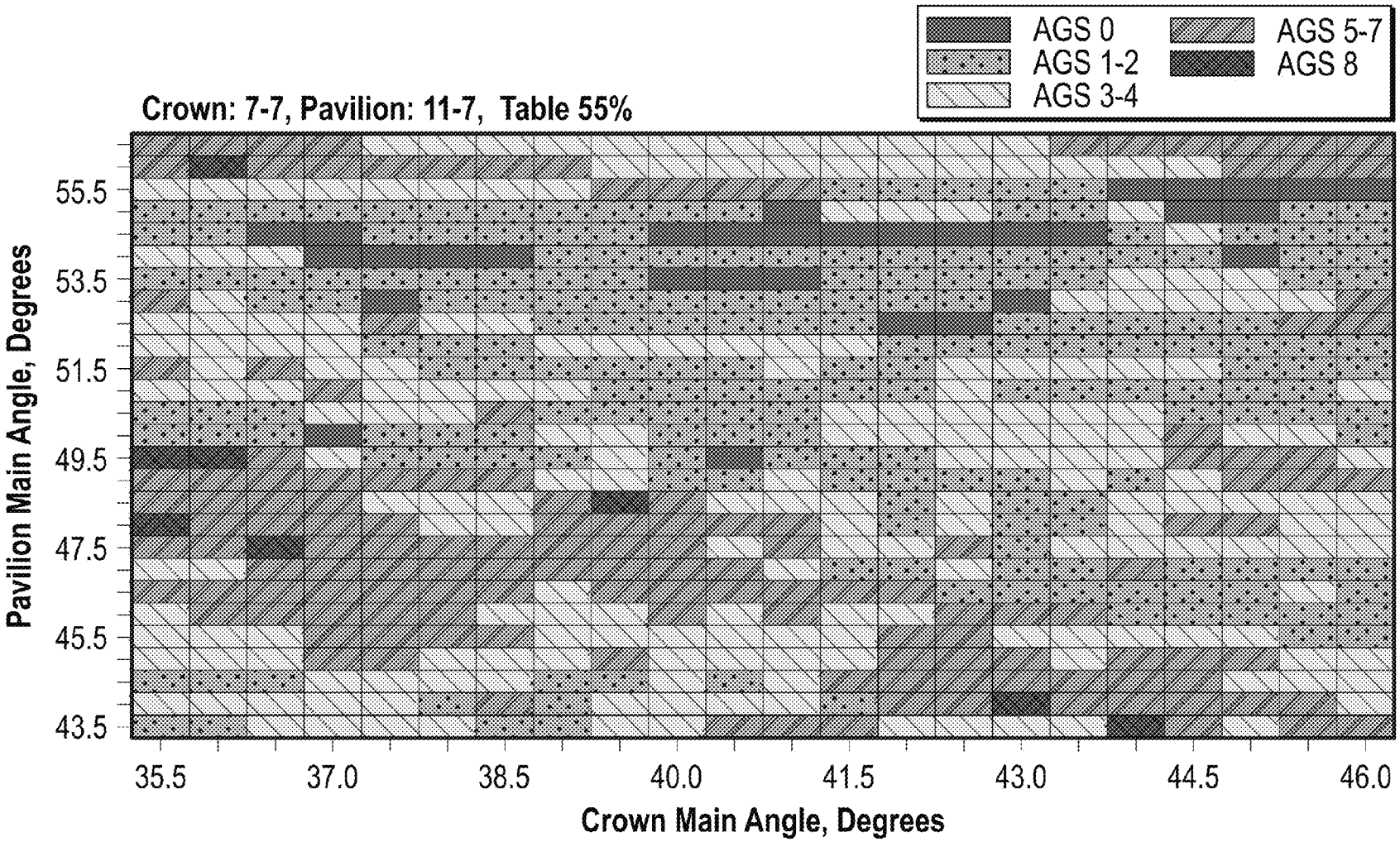
FIG. 6 (Prior Art)
FIG. 6 is a map of the light performance grades of an emerald-cut diamond according to the AGS Guidelines at cdn.ymaws.com/www.americangemsociety.org/resource/collection/5BCC3840-BEFB-48B7-A29D-61E4068B85F6/1pt4_14.pdf for a diamond with an L/W ratio of 1.4, corner ratio of 0.14, a table % of 55, crown breaks of 7-7, and pavilion breaks of 11-7, over ranges of crown main angles of 35.5-46 and pavilion main angles of 43.5-56.5.
Figure 7:
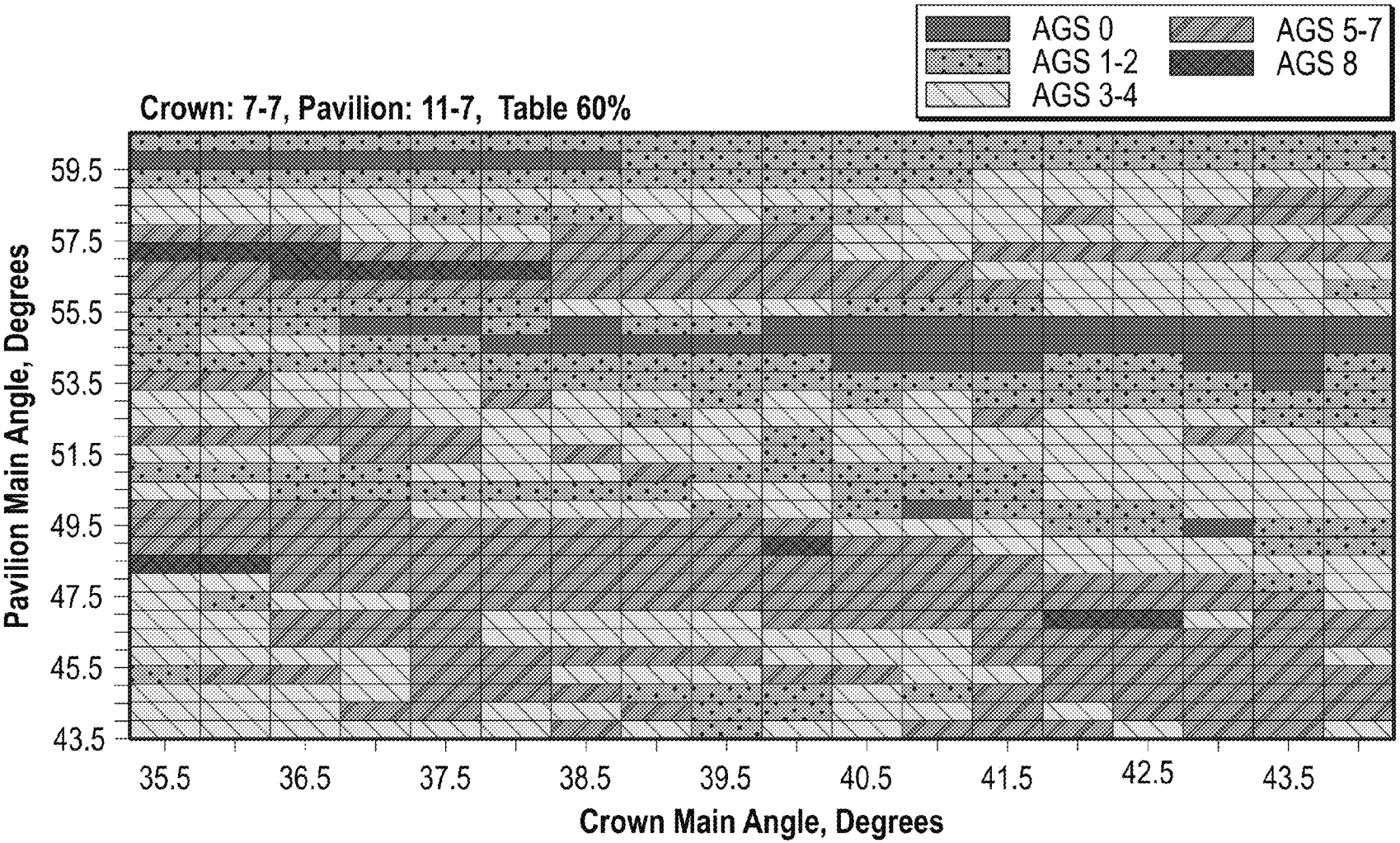
FIG. 7 (Prior Art)
FIG. 7 is a map of the light performance grades of an emerald-cut diamond according to the AGS Guidelines at cdn.ymaws.com/www.americangemsociety.org/resource/collection/5BCC3840-BEFB-48B7-A29D-61E4068B85F6/1pt4_14.pdf for a diamond with an L/W ratio of 1.4, corner ratio of 0.14, a table % of 60, crown breaks of 7-7 and pavilion breaks of 11-7 over ranges of crown main angles of 35.5-44 and pavilion main angles of 43.5-59.5.

The "0-grade domain density" of a grade map, as used herein, represents the fraction of pavilion main/crown main angle combinations that obtain a grade of 0 out of the total pavilion main/crown main angle combinations in a grade map or portion thereof. For example, FIG. 6 shows 30 pavilion/crown main angle combinations having a light performance grade of 0, and a total of 594 total pavilion/crown main angle combinations, for a 0-grade domain density of 0.051 (or 5.1%). Similarly, FIG. 4 shows a 0-grade domain density of 0.156, and FIG. 7 shows a 0-grade domain density of 0.077.

As used herein, all numbers and values have a range of accuracy that is plus or minus one-half of the significant digit provided, unless otherwise indicated. For example, an angle given as 41.00 degrees is ±0.005 degrees; or a range of angles given as "28 to 45 degrees (±0.25)" is 27.75 to 45.25. The parenthetical indication of plus or minus following a list of values or ranges of values is intended to apply to each non-zero value and each of the non-zero range endpoint values, whereas the non-zero values may be up to or equal to the indicated plus value.

In an embodiment, an emerald-cut diamond comprises a ratio of length to width, measured at a girdle between a crown and a pavilion ("the girdle width"), of from about 1.35 to 1.40 (±0.025); a table having a width of from about 55 to 60 percent (±0.5) of the width of the diamond measured at the girdle; a girdle thickness of up to about 3 percent, preferably from greater than 0 up to about 3 percent (±0.5) of the girdle width; a crown main facet tier adjacent the girdle having an angle with respect to the table plane of from about 28 to 45 degrees (±0.25); a first crown break angle between the crown main tier and an adjacent crown second tier from about 2 to 6 degrees, preferably about 3 to 5 degrees (±0.5); a second crown break angle between the crown second tier and an adjacent crown third tier from about 2 to 6 degrees, preferably about 3 to 6 degrees (±0.5); a pavilion main facet tier adjacent the girdle having an angle with respect to the table plane of from about 43 to 48 degrees (±0.25); a first pavilion break angle between the pavilion main tier and an adjacent pavilion second tier from about 2 to 6 degrees, preferably about 3 to 5 degrees (±0.5); and/or a second pavilion break angle between the pavilion second tier and an adjacent pavilion third tier from about 2 to 6 degrees, preferably about 2 to 5 degrees (±0.5). Preferably, a corner ratio is from about 13.5 to 14.5 percent, more preferably about 14.0 percent (±0.25) of the girdle width.

In a preferred embodiment, the first crown break angle is from about 3 to 5 degrees (±0.5); the second crown break angle is from about 3 to 6 degrees (±0.5); the first pavilion break angle is from about 3 to S degrees (±0.5); and the second pavilion break angle is from about 2 to 5 degrees (±0.5).

The emerald-cut diamond may have a light performance grade of 1, preferably a light performance grade of 0. For example, the emerald-cut diamond may preferably have light performance deductions less than about 1.50, or less than about 1.00, or more preferably AGS light performance deductions less than about 0.10, or less than about 0.40, or less than about 0.30, or less than about 0.20, or less than about 0.10, or about 0.00 (±0.005).

The pavilion third tier of the emerald-cut diamond may terminate at a culet, e.g., the diamond may be a "three-tier" emerald-cut. In a preferred embodiment, the emerald-cut diamond may have first and second crown break angles of about 4 and 3 degrees (±0.5), respectively. The crown main angle is preferably from about 35 to 45 degrees (±0.25). Preferably, the first and second pavilion break angles are from about 3 to 5 degrees (±0.5), and more preferably as follows:

- the first pavilion break angle is about 3 degrees, the second pavilion break angle is about 4 or 5 degrees (±0.5), the pavilion main angle is from about 43.0 to 46.5 degrees (±0.25), and especially where an AGS light performance grade is 0; or,
- the first and second pavilion break angles are about 5 and 4 degrees (±0.5), respectively, the pavilion main angle is from about 43.5 to 48.0 degrees (±0.25), and especially where the AGS light performance grade is 0; or,
- the first and second pavilion break angles are each about 5 degrees (±0.5), the pavilion main angle is from about 44.5 to 48.0 degrees (±0.25), and especially where the AGS light performance grade is 0.

In an embodiment, the emerald-cut diamond may further comprise a third pavilion break angle between the pavilion third tier and an adjacent pavilion fourth tier from about 2 to 6 degrees, preferably about 2 to 5 degrees (±0.5), e.g., the diamond may be a "four-tier" emerald-cut where the fourth tier terminates at a culet, or it may have 5 or more tiers. Preferably, the four-tier emerald-cut may have a first pavilion break angle from about 2 to 4 degrees, preferably about 3 to 4 degrees (±0.5), a second pavilion break angle from about 2 to 4 degrees, preferably about 2 to 3 degrees (±0.5), and a third pavilion break angle from about 2 to 4 degrees, preferably about 2 to 3 degrees (±0.5). The four-tier emerald-cut diamond may have a light performance grade of 1, preferably 0.

In another aspect, the present invention provides a method for cutting an emerald-cut diamond with Excellent or preferably Ideal light performance characteristics. The method may allow selection of crown and pavilion mains angles from a relatively wide range that may facilitate achieving a light performance grade of 1 or preferably 0, for example. By selecting from within these parameters in a 0-grade domain of a grade map, the cutter has improved flexibility for the selection, and greater forgiveness in deviations from the selected parameters during cutting, to obtain an emerald-cut diamond with a light performance grade of 1 or preferably 0, for example.

In one embodiment, a method for cutting a diamond to have emerald-cut parameters comprises cutting the diamond in a rectangular plan with a ratio of length to width, measured at a girdle between a crown and a pavilion of the diamond, of from about 1.35 to 1.40 (±0.025); forming corners on the diamond; forming a table on the crown of the diamond having a width of from about 55 to 60 percent (+0.5) of the girdle width; forming a thickness of the girdle from greater than 0 up to about 3 percent (±0.5) of the girdle width; forming a crown main facet tier adjacent the girdle having an angle with respect to the table plane of from about 28 to 45 degrees (±0.25); forming a crown second tier facet adjacent the crown main facet tier having a first crown break angle between the crown main and second tiers from about 2 to 6 degrees, preferably about 3 to 5 degrees (±0.5); forming a crown third tier facet adjacent the second crown tier facet having a second crown break angle between the crown second and third tiers from about 2 to 6 degrees, preferably about 3 to 6 degrees (±0.5); forming a pavilion main facet tier adjacent the girdle having an angle with respect to the table plane of from about 43 to 48 degrees (±0.25); forming a pavilion second tier facet adjacent the pavilion main facet tier having a first pavilion break angle between the pavilion main and second tiers from about 2 to 6 degrees, preferably about 3 to 5 degrees (±0.5); and forming a pavilion third tier facet adjacent the pavilion second tier facet having a second pavilion break angle between the pavilion second and third tiers from about 2 to 6 degrees, preferably about 2 to 5 degrees (±0.5). In an embodiment, the method may comprise polishing the diamond to at least an Excellent polish and at least Excellent symmetry (AGS), preferably Ideal polish and Ideal symmetry (AGS). Preferably, the corners have a corner ratio of from about 14.0 to 14.5 percent (±0.25) of the girdle width In any embodiment, the method may further comprise selecting cutting parameters comprising crown and pavilion main tier facet angles from a 1- or preferably 0-grade domain of a grade map, and cutting the diamond according to the selected cutting parameters, preferably to obtain a light performance grade of 1 or more preferably 0. In any embodiment, the method may comprise selecting the ratio of length to width, the corner ratio, the table percentage, first and second crown break angles, first and second pavilion break angles, and ranges of the crown main angle and pavilion main angle corresponding to a grade map of light performance deductions for combinations of the crown and pavilion main angles over said ranges; selecting cutting parameters comprising crown and pavilion main angles from the grade map corresponding to a 0-grade domain; and cutting the diamond sufficiently close to the selected cutting parameters, preferably within 0.25 degrees of each of the selected crown and pavilion main tier and first and second break angles, to obtain a light performance grade of 0. For example, the emerald-cut diamond may preferably have light performance deductions less than about 1.50, or less than about 1.00, or more preferably light performance deductions less than about 0.50, or less than about 0.40, or less than about 0.30, or less than about 0.20, or less than about 0.10, or about 0.00 (±0.005). In any embodiment, the grade map may comprise a 0-grade domain density equal to or greater than 0.25, preferably greater than or equal to 0.30, 0.35, 0.40, 0.50, or 0.60.

The pavilion third tier of the emerald-cut diamond may be terminated at a culet, e.g., the diamond may be a "three-tier" emerald-cut. In a preferred embodiment, the emerald-cut diamond may be formed with first and second crown break angles of about 4 and 3 degrees (±0.5), respectively. The crown main angle is preferably formed at from about 35 to 45 degrees (±0.25). Preferably, the first and second pavilion break angles are formed at from about 3 to 5 degrees (±0.5), and more preferably as follows.

- the first pavilion break angle is formed at about 3 degrees, the second pavilion break angle is formed at about 4 or 5 degrees (±0.5), the pavilion main angle is formed at from about 43.0 to 46.5 degrees (±0.25), and especially where an AGS light performance grade is 0; or,
- the first and second pavilion break angles are formed at about 5 and 4 degrees (±0.5), respectively, the pavilion main angle is formed at from about 43.5 to 48.0 degrees (±0.25), and especially where the AGS light performance grade is 0; or,
- the first and second pavilion break angles are each formed at about 5 degrees (±0.5), the pavilion main angle is formed at from about 44.5 to 48.0 degrees (±0.25), and especially where the AGS light performance grade is 0.

In any embodiment of the method for cutting the three-tier emerald-cut diamond, the method may further comprise selecting the ratio of length to width, the corner ratio, the table percentage, first and second crown break angles, first and second pavilion break angles, and ranges of the crown main angle and pavilion main angle corresponding to a grade map of light performance deductions for combinations of the crown and pavilion main angles over said ranges; selecting cutting parameters comprising crown and pavilion main angles from the grade map corresponding to a 0-grade domain; and cutting the diamond sufficiently close to the selected cutting parameters, preferably within 0.25 degrees of each of the selected crown and pavilion main and first and second break angles, to obtain a light performance grade of 0.

In an embodiment, the method may further comprise forming a third pavilion break angle between the pavilion third tier and an adjacent pavilion fourth tier from about 2 to 6 degrees, preferably about 2 to 5 degrees (±0.5), e.g., the diamond may be a "four-tier" emerald-cut where the fourth tier terminates at a culet, or it may have 5 or more tiers. Preferably, the four-tier emerald-cut may be formed with a first pavilion break angle from about 2 to 4 degrees, preferably about 3 to 4 degrees (±0.5), a second pavilion break angle from about 2 to 4 degrees, preferably about 2 to 3 degrees (±0.5), and a third pavilion break angle from about 2 to 4 degrees, preferably about 2 to 3 degrees (±0.5). In any embodiment, the method may further comprise selecting the ratio of length to width, the corner ratio, the table percentage, first and second crown break angles, first, second, and third pavilion break angles, and ranges of the crown main angle and pavilion main angle corresponding to a grade map of light performance deductions for combinations of the crown and pavilion main angles over said ranges; selecting cutting parameters comprising crown and pavilion main angles from the grade map corresponding to a 0-grade domain; and cutting the diamond sufficiently close to the selected cutting parameters, preferably within 0.25 degrees of each of the selected crown and pavilion main and first and second break angles and the third pavilion break angle, to obtain a light performance grade of 0.

In any embodiment, the method may further comprise selecting cutting parameters comprising crown and pavilion main tier facet angles from an AGS an AGS 0 area of an ASET map; and cutting the diamond according to the selected cutting parameters to obtain an AGS light performance grade of 1, or preferably 0. Preferably, the ASET map comprises a continuous AGS 0 area having extents of at least 1.5 degrees, preferably at least 2.0 degrees, more preferably at least 2.5 degrees over domains of the crown and pavilion mains angles.

The invention is illustrated by the following examples.

EXAMPLES

In the following examples, ASET images for virtual diamonds were simulated, and the light performance deductions, grades and maps, calculated by the American Gem Society Laboratories.

Example 1

Figure 8A:
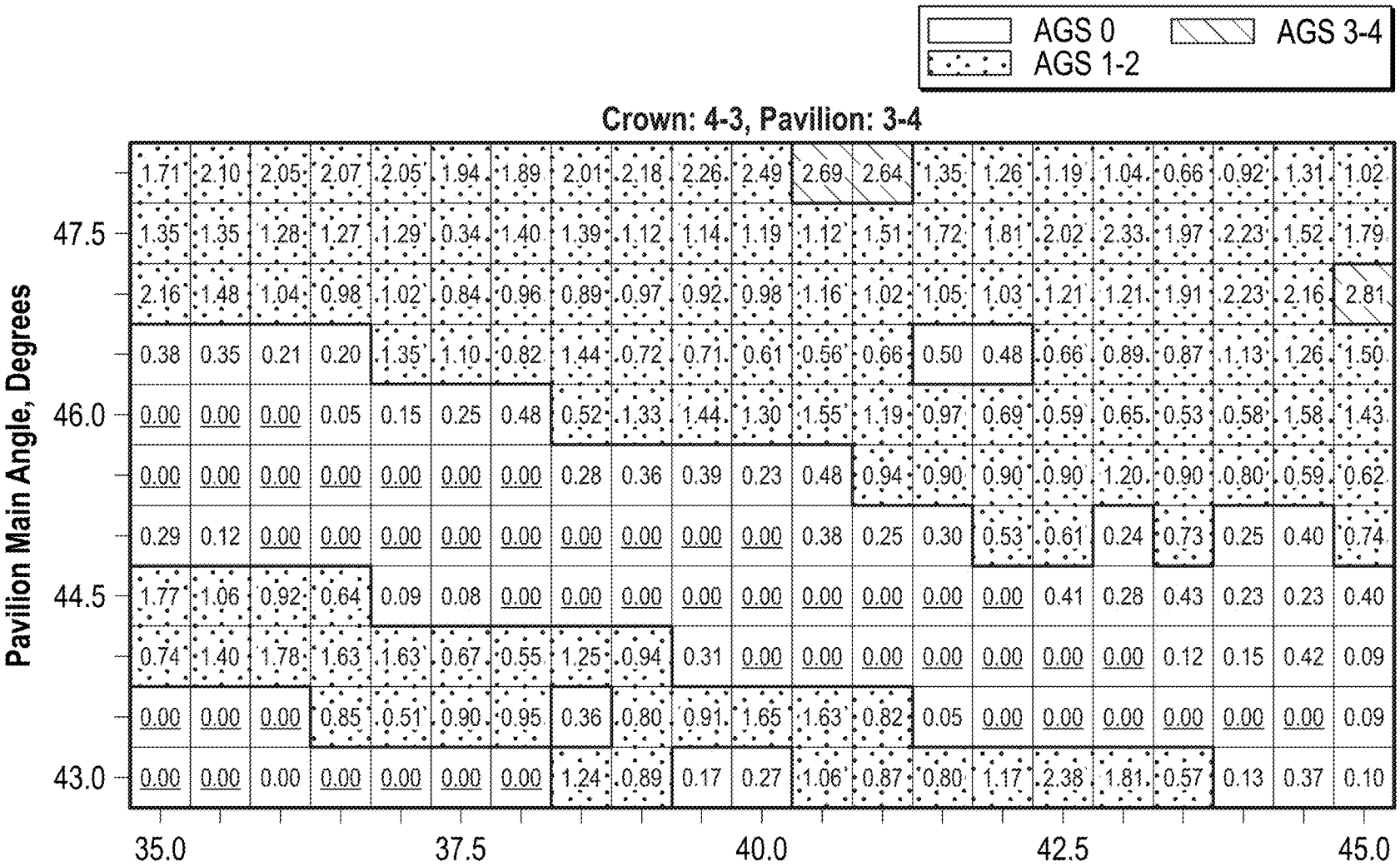
FIG. 8A is a map of the light performance grades of an emerald-cut diamond according to an embodiment of the present invention for a diamond with L/W ratio 1.35, corner ratio 14%, a table % of 55, crown breaks of 4-3 and pavilion breaks of 3-4 over ranges of crown main angles of 35.0-45.0 and pavilion main angles of 43.0-48.0.
Figure 8B:
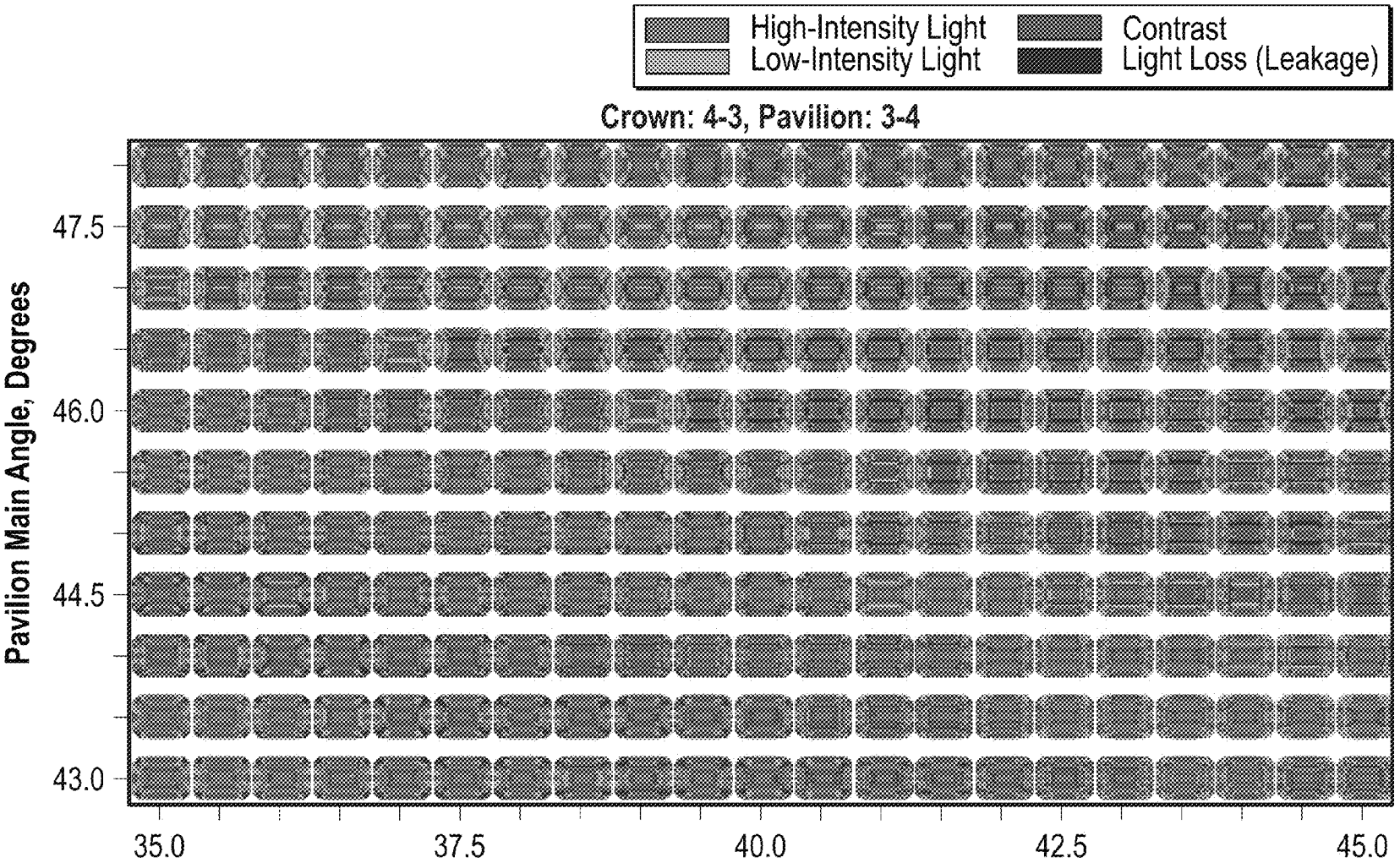
FIG. 8B is a chart of ASET images for the emerald-cut diamonds of FIG. 8A.

Light performance deductions and ASET images were determined for a virtual emerald-cut diamond having a table % of 55, L/W ratio 1.35, corner ratio 140, crown breaks of 4-3 and pavilion breaks of 3-4 over ranges of crown main angles of 35.0-45.0 degrees and pavilion main angles of 43.0-48.0 degrees. The light performance deductions are shown in the map of FIG. 8A and the corresponding ASET images in FIG. 8B. The 0-grade domain density is 0.411.

Example 2

Figure 9A:
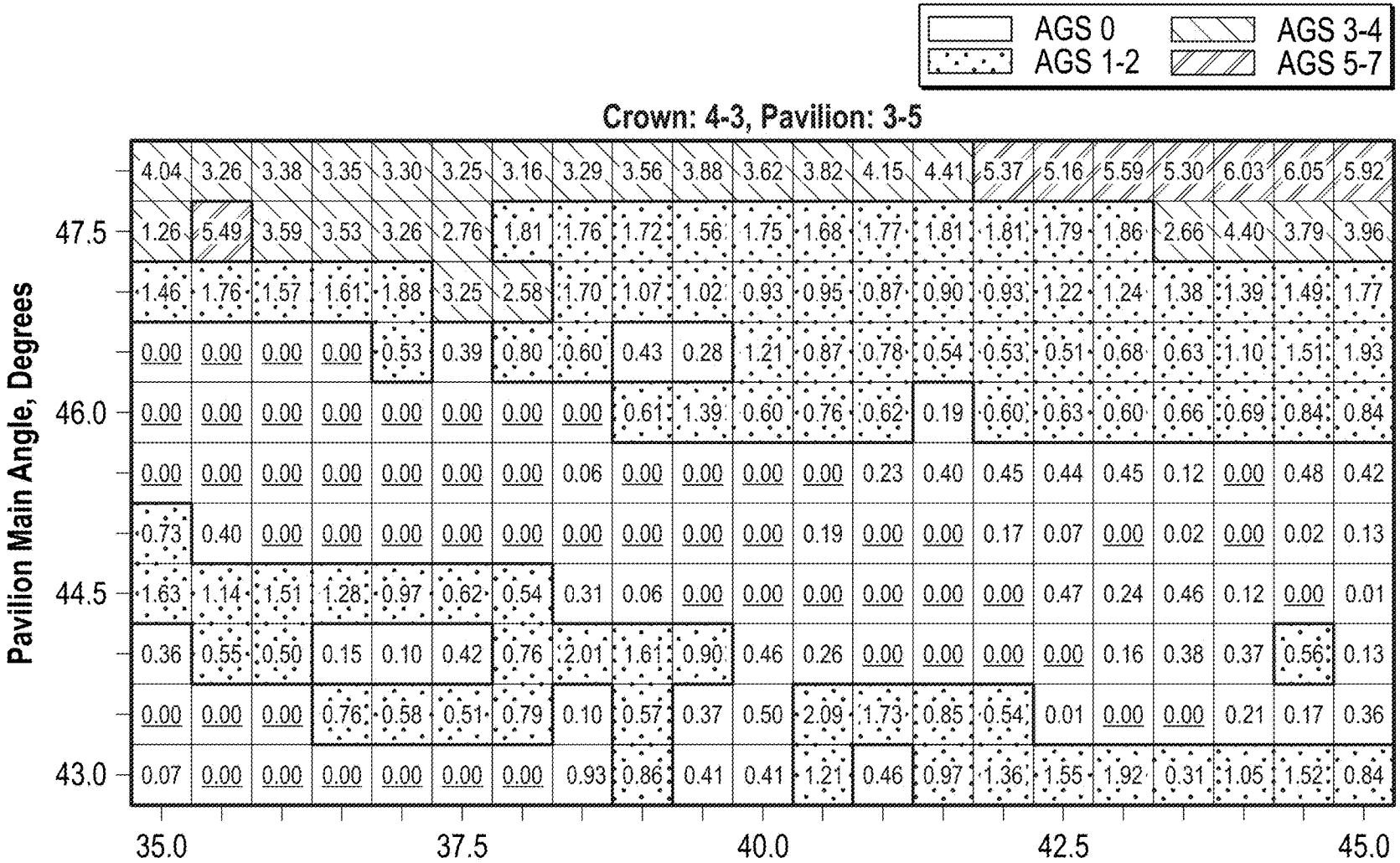
FIG. 9A is a map of the light performance grades of an emerald-cut diamond according to an embodiment of the present invention for a diamond with L/W ratio 1.35, corner ratio 14%, a table % of 55, crown breaks of 4-3 and pavilion breaks of 3-5 over ranges of crown main angles of 35.0-45.0 and pavilion main angles of 43.0-48.0.
Figure 9B:
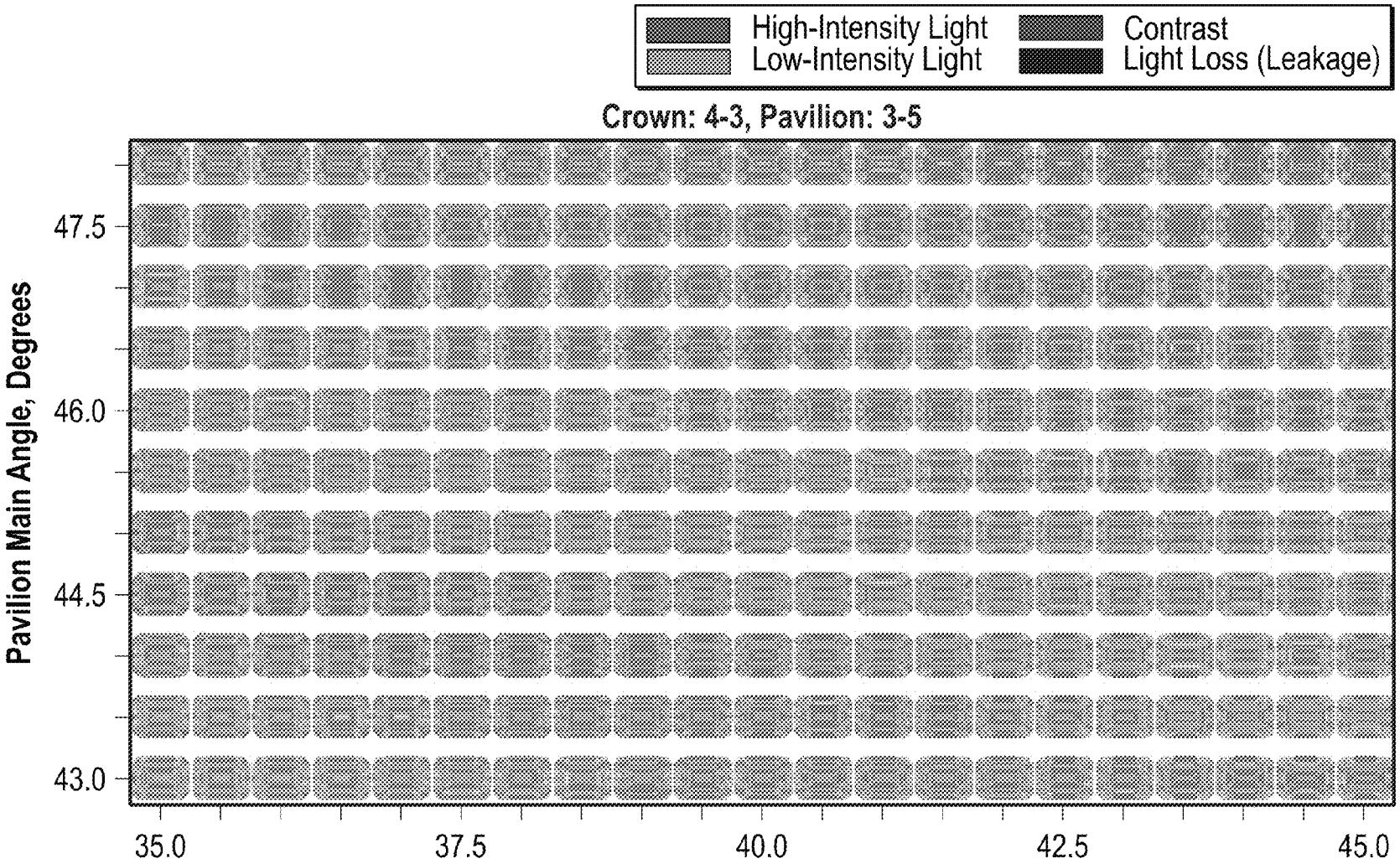
FIG. 9B is a chart of ASET images for the emerald-cut diamonds of FIG. 9A.

Light performance deductions and ASET images were determined for a virtual emerald-cut diamond having a table % of 55, L/W ratio 1.35, corner ratio 140, crown breaks of 4-3 and pavilion breaks of 3-5 over ranges of crown main angles of 35.0-45.0 degrees and pavilion main angles of 43.0-48.0 degrees. The light performance deductions are shown in the map of FIG. 9A and the corresponding ASET images in FIG. 9B. The 0-grade domain density is 0.472.

Example 3

Figure 10A:
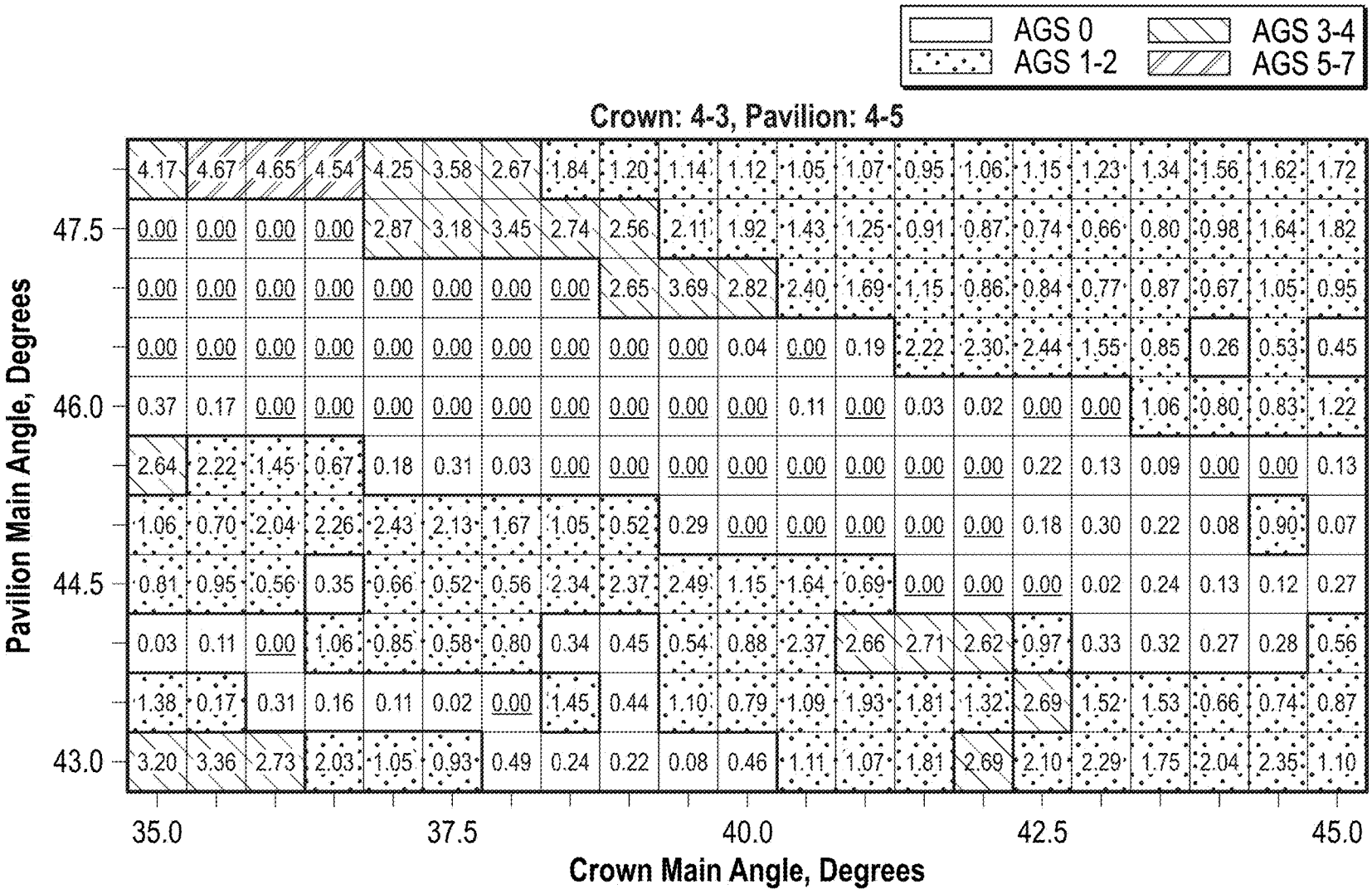
FIG. 10A is a map of the light performance grades of an emerald-cut diamond according to an embodiment of the present invention for a diamond with L/W ratio 1.35, corner ratio 14%, a table % of 55, crown breaks of 4-3 and pavilion breaks of 4-5 over ranges of crown main angles of 35.0-45.0 and pavilion main angles of 43.0-48.0.
Figure 10B:
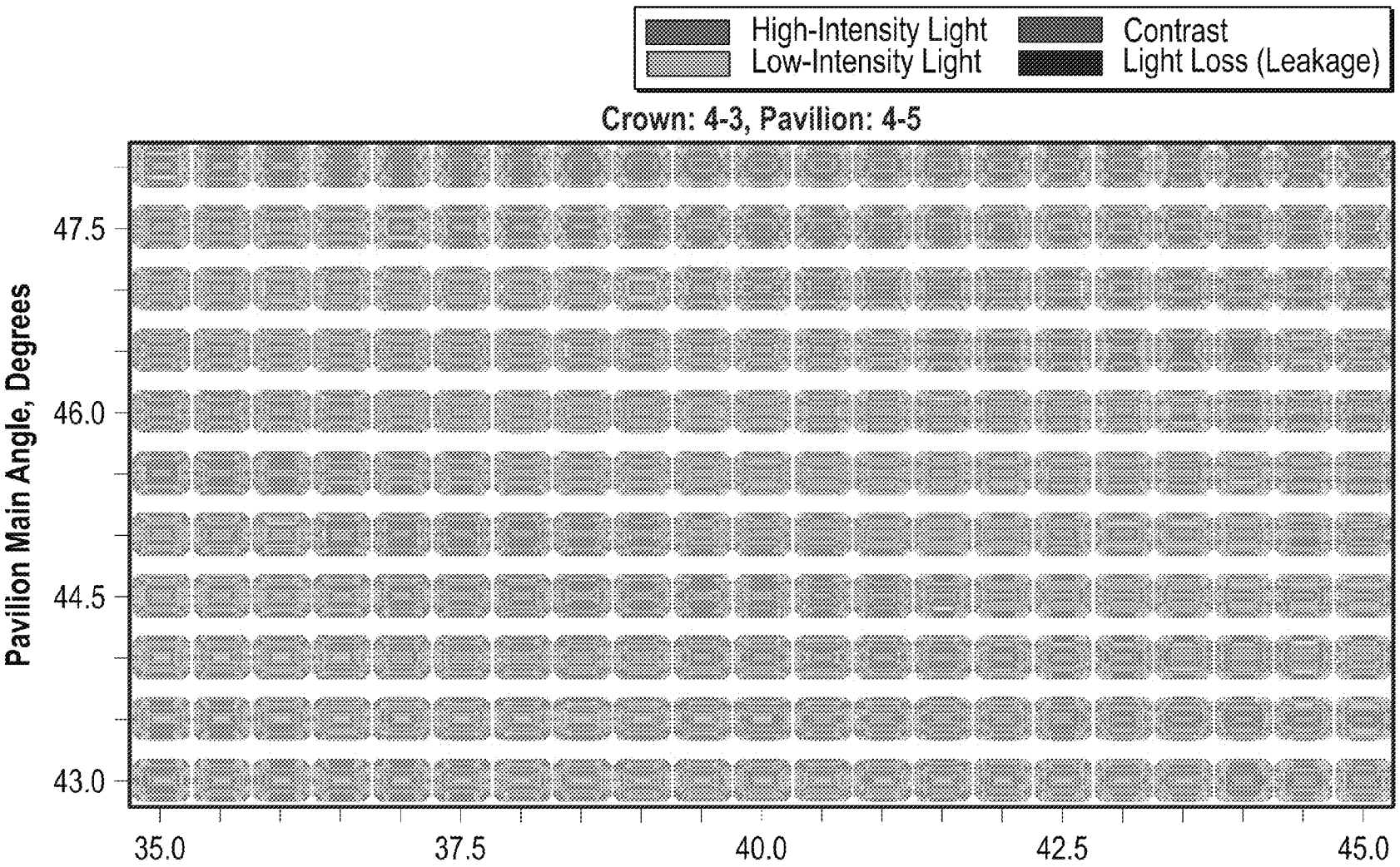
FIG. 10B is a chart of ASET images for the emerald-cut diamonds of FIG. 10A.

Light performance deductions and ASET images were determined for a virtual emerald-cut diamond having a table % of 55, L/W ratio 1.35, corner ratio 140, crown breaks of 4-3 and pavilion breaks of 4-5 over ranges of crown main angles of 35.0-45.0 degrees and pavilion main angles of 43.0-48.0 degrees. The light performance deductions are shown in the map of FIG. 10A and the corresponding ASET images in FIG. 10B. The 0-grade domain density is 0.450.

Example 4

Figure 1:
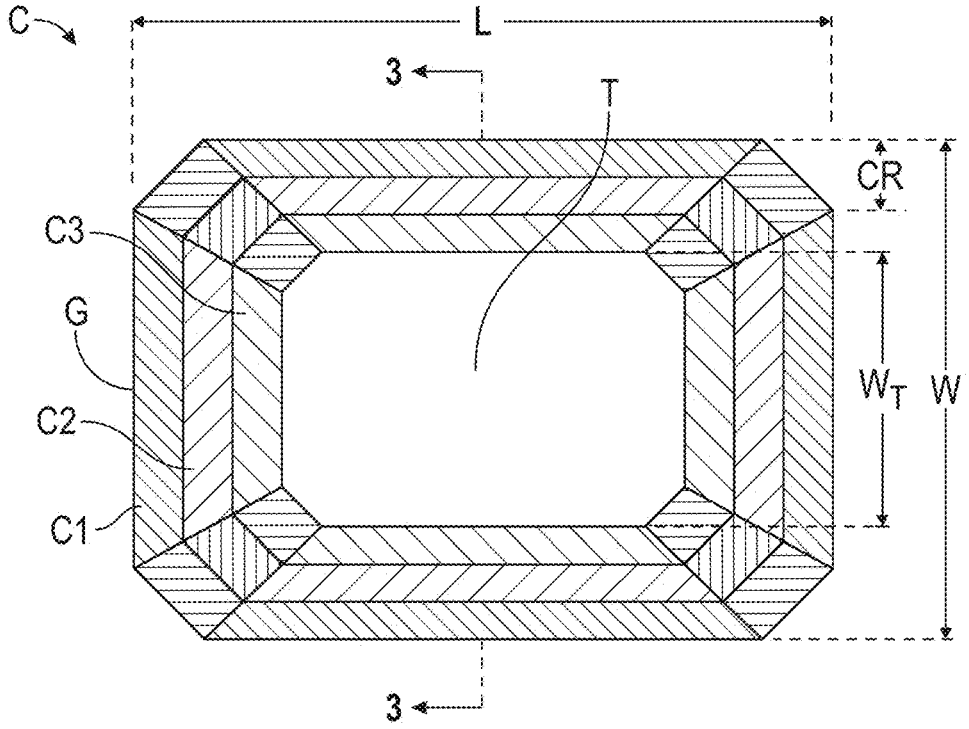
FIG. 1 is a top plan view of an emerald-cut diamond showing parameters according to an embodiment of the present invention.
Figure 2:
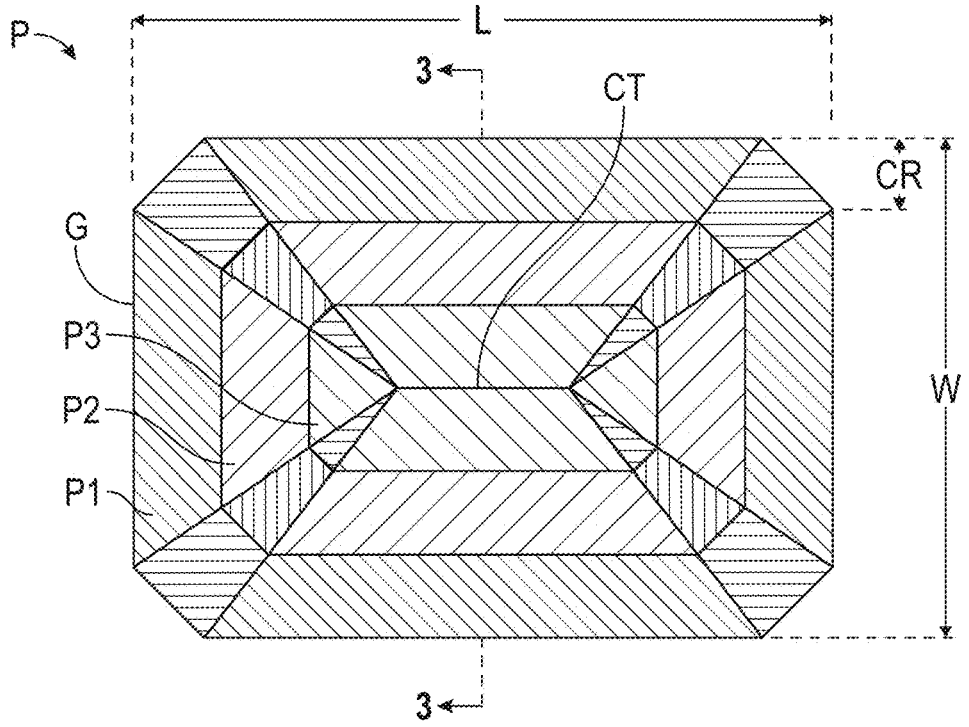
FIG. 2 is a bottom plan view of an emerald-cut diamond showing parameters according to an embodiment of the present invention.
Figure 3A:
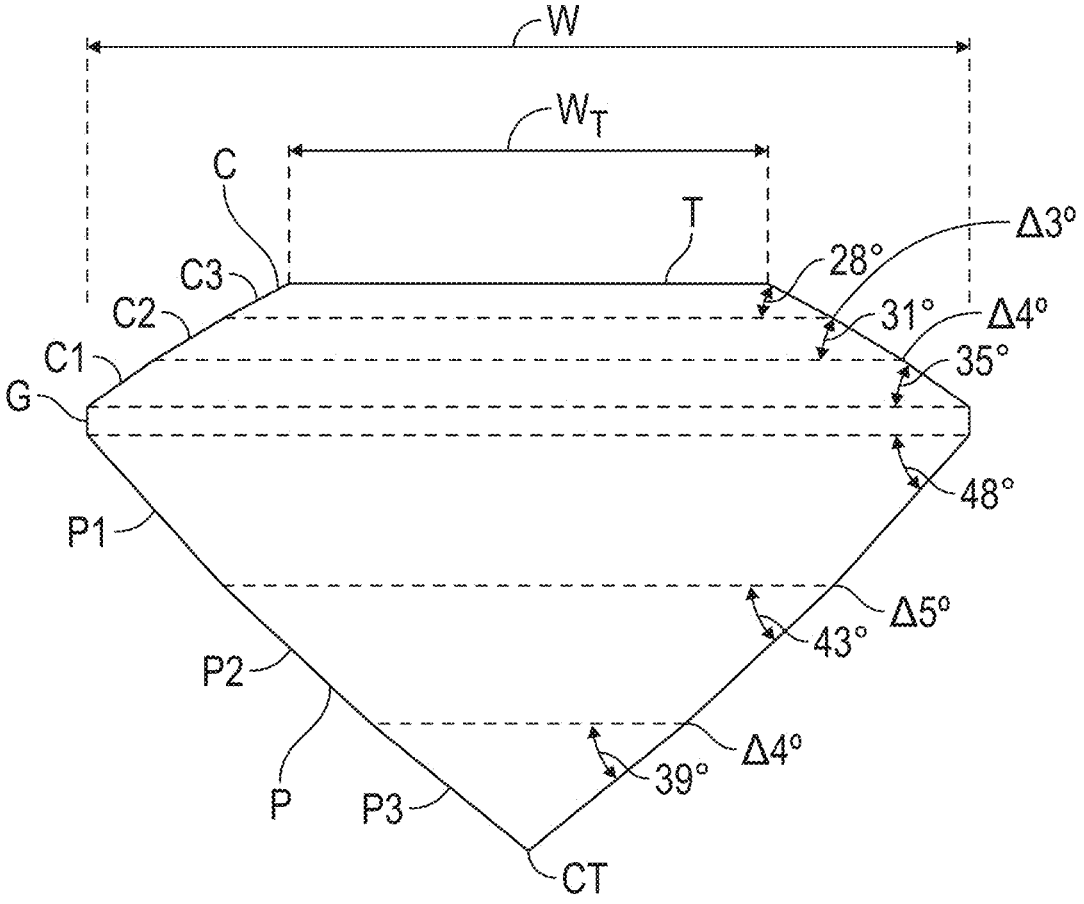
FIG. 3A is a side sectional view of an emerald-cut diamond as seen along the view lines 3-3 of FIGS. 1 and 2 showing parameters according to an embodiment of the present invention described in Example 4 below.
Figure 11A:
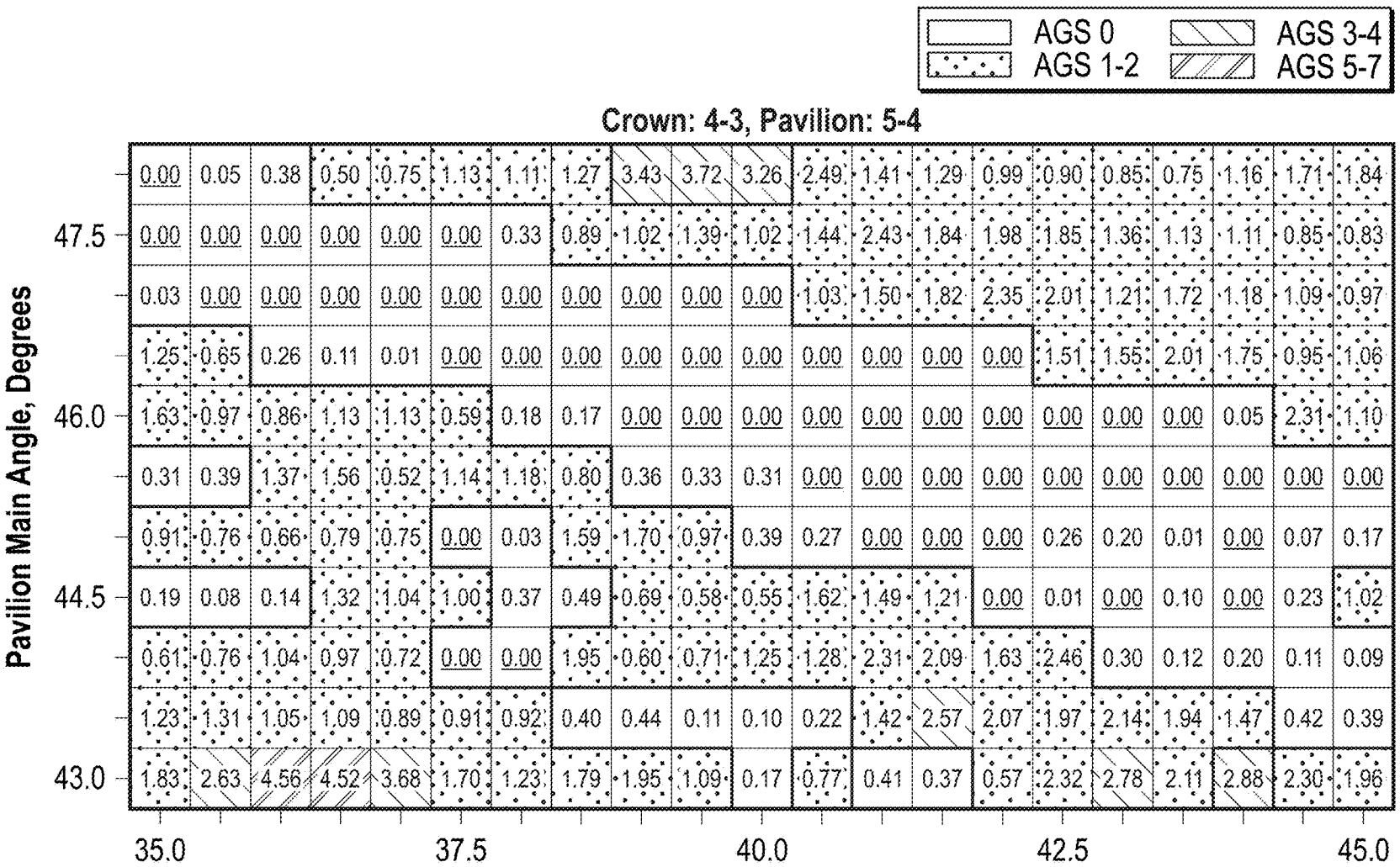
FIG. 11A is a map of the light performance grades of an emerald-cut diamond according to an embodiment of the present invention for a diamond with L/W ratio 1.35, corner ratio 14%, a table % of 55, crown breaks of 4-3 and pavilion breaks of 5-4 over ranges of crown main angles of 35.0-45.0 and pavilion main angles of 43.0-48.0.
Figure 11B:
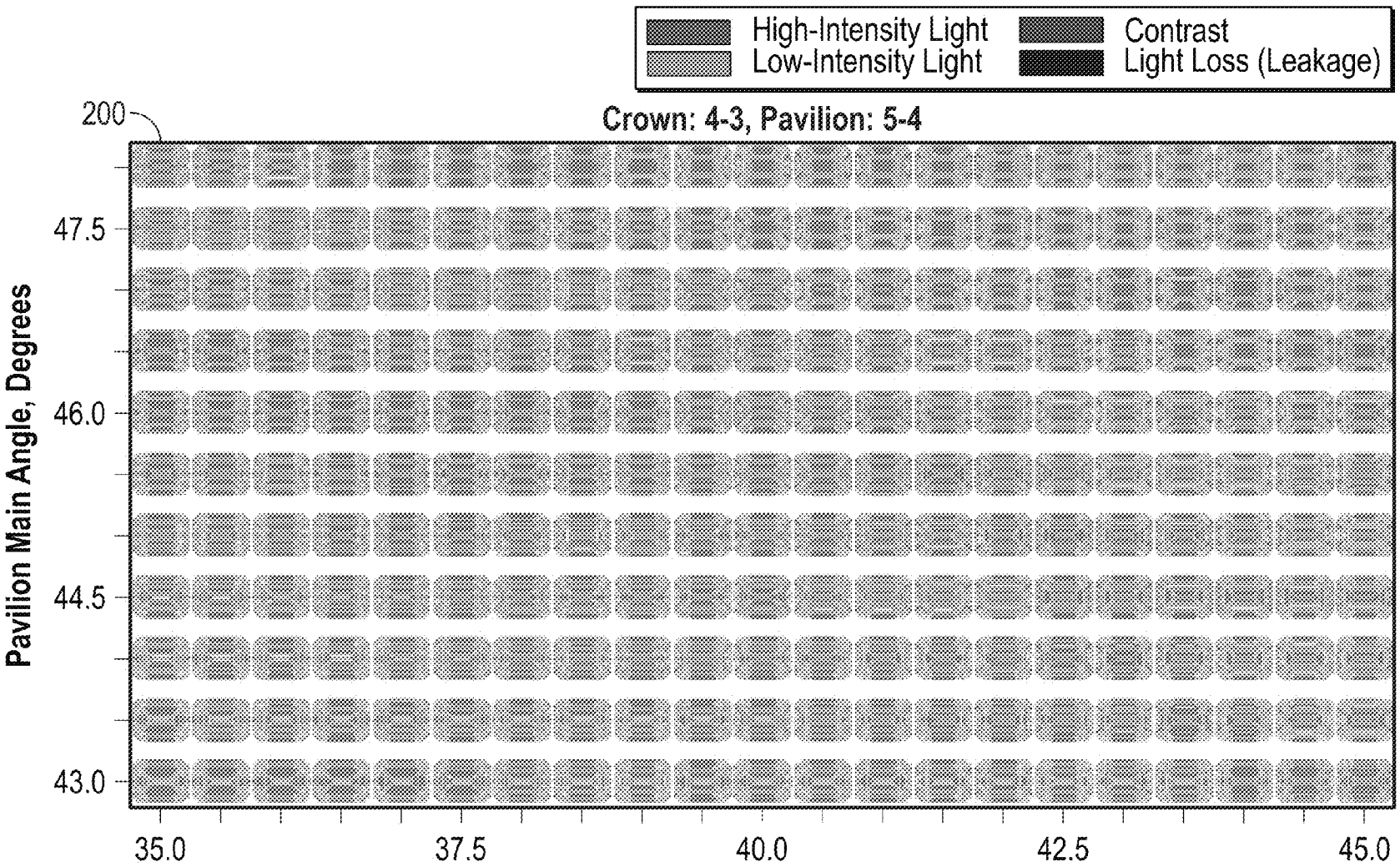
FIG. 11B is a chart of ASET images for the emerald-cut diamonds of FIG. 11A.

Light performance deductions and ASET images were determined for a virtual emerald-cut diamond having a table % of 55, L/W ratio 1.35, corner ratio 14%, crown breaks of 4-3 and pavilion breaks of 5-4 over ranges of crown main angles of 35.0-45.0 degrees and pavilion main angles of 43.0-48.0 degrees. The light performance deductions are shown in the map of FIG. 11A and the corresponding ASET images in FIG. 11B. The 0-grade domain density is 0.441. FIG. 3A is a side sectional view of an Example 4 diamond with a crown main angle of 35.0 degrees and a pavilion main angle of 48.0 degrees, which has 0.00 performance deductions (FIG. 11A) and the ASET image 200 (FIG. 11B).

Example 5

Figure 12A:
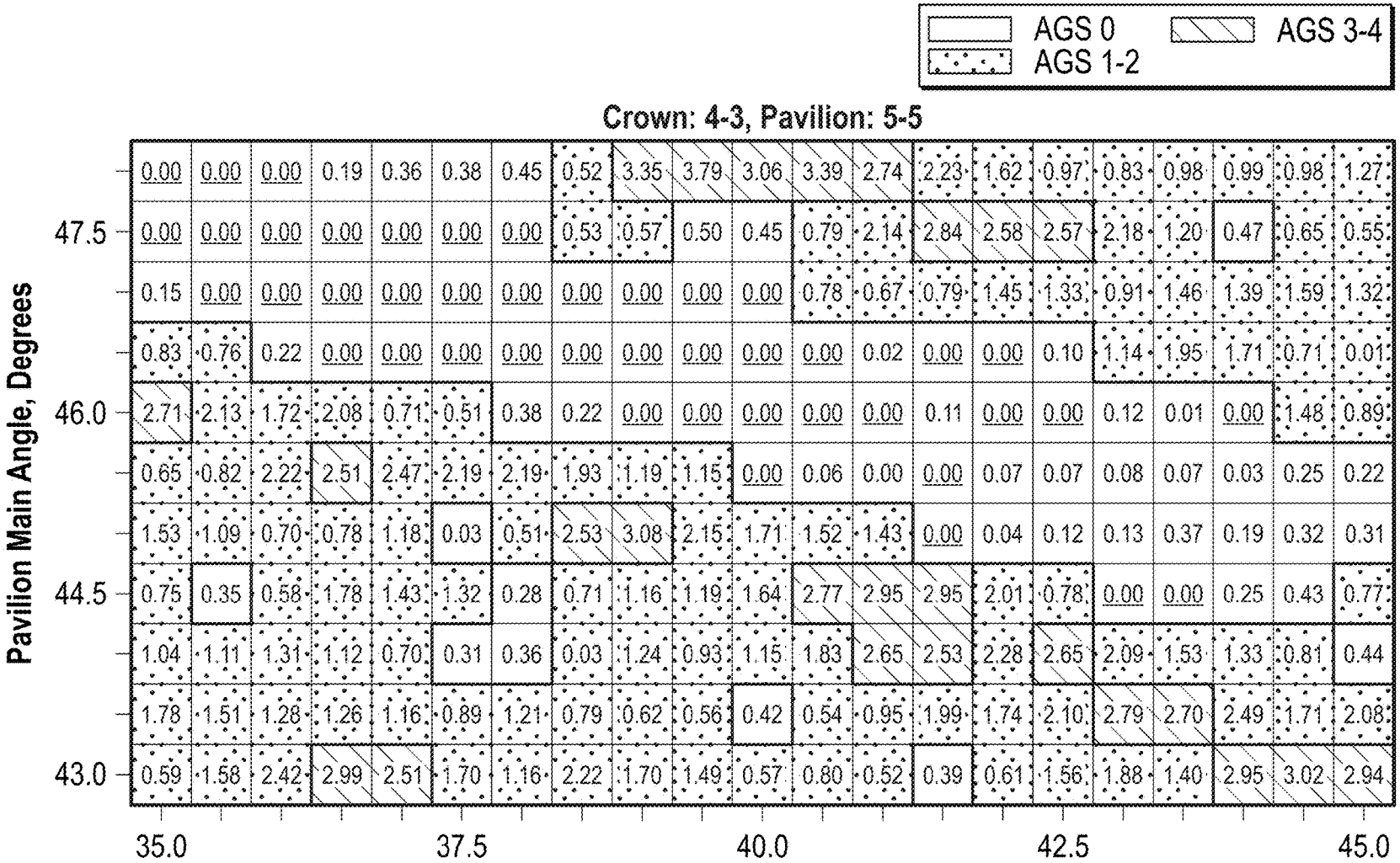
FIG. 12A is a map of the light performance grades of an emerald-cut diamond according to an embodiment of the present invention for a diamond with L/W ratio 1.35, corner ratio 14%, a table % of 55, crown breaks of 4-3 and pavilion breaks of 5-5 over ranges of crown main angles of 35.0-45.0 and pavilion main angles of 43.0-48.0.
Figure 12B:
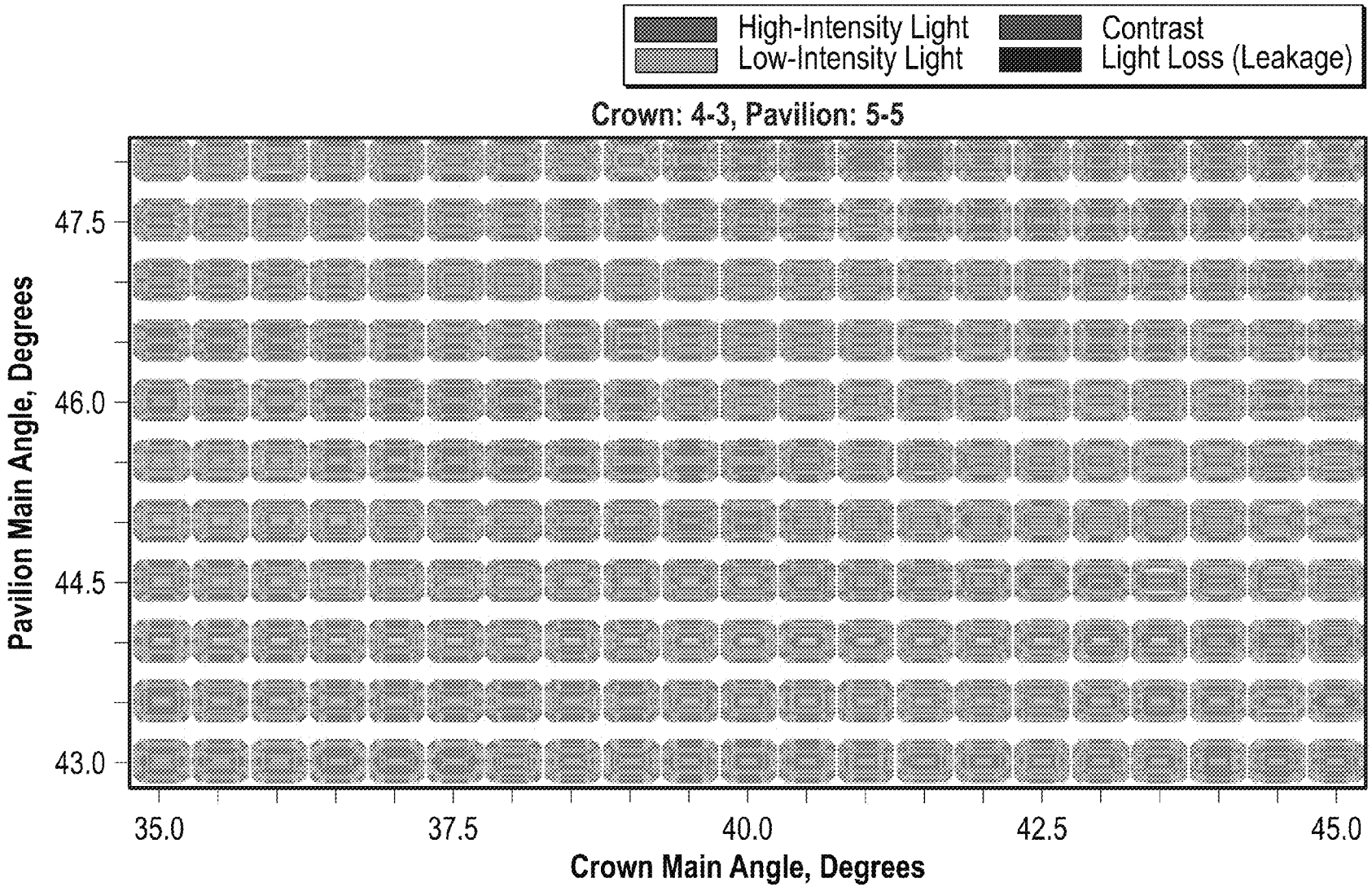
FIG. 12B is a chart of ASET images for the emerald-cut diamonds of FIG. 12A.

Light performance deductions and ASET images were determined for a virtual emerald-cut diamond having a table % of 55, L/W ratio 1.35, corner ratio 14%, crown breaks of 4-3 and pavilion breaks of 5-5 over ranges of crown main angles of 35.0-45.0 degrees and pavilion main angles of 43.0-48.0 degrees. The light performance deductions are shown in the map of FIG. 12A and the corresponding ASET images in FIG. 12B. The 0-grade domain density is 0.372.

Example 6

Figure 3B:
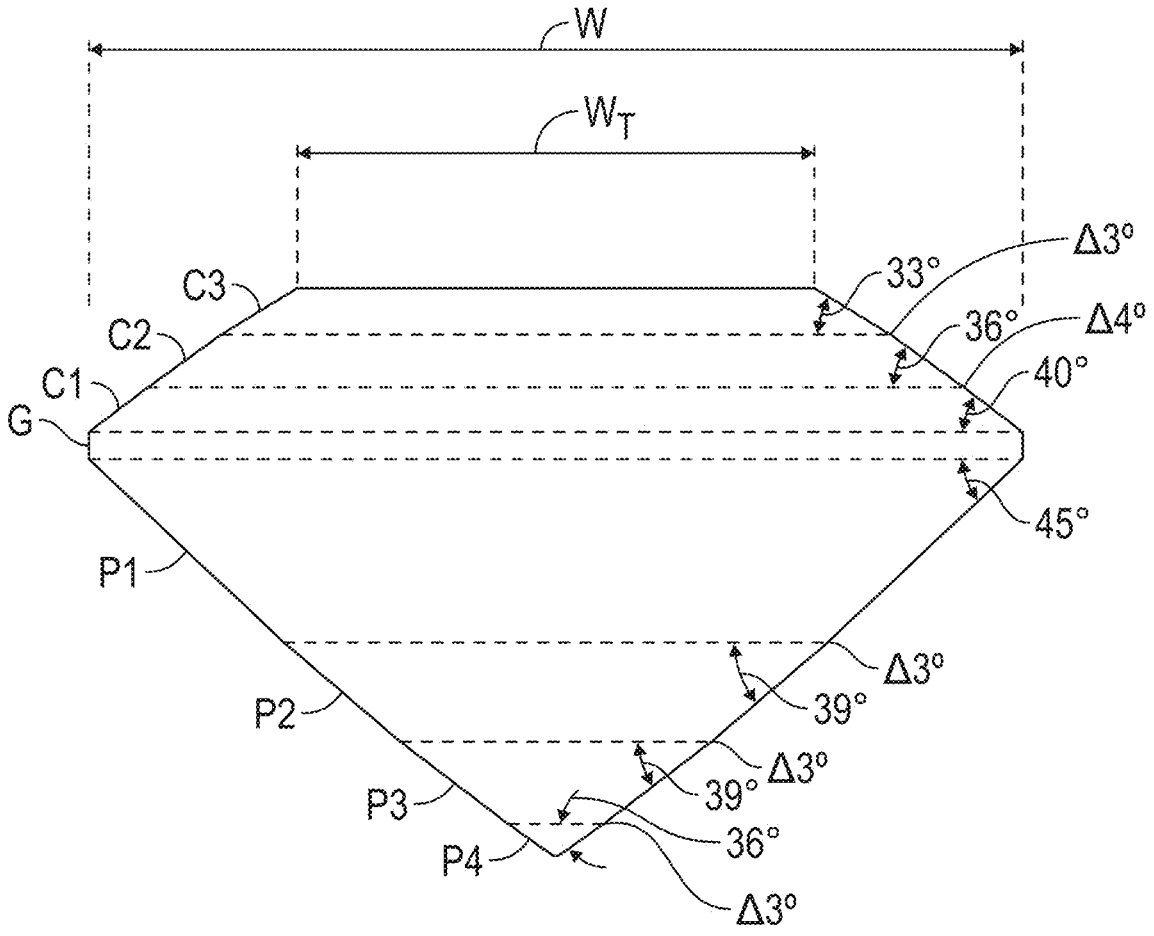
FIG. 3B is a side sectional view of a four-tier pavilion, emerald-cut diamond according to an embodiment of the present invention described in Example 6 below.
Figure 13:
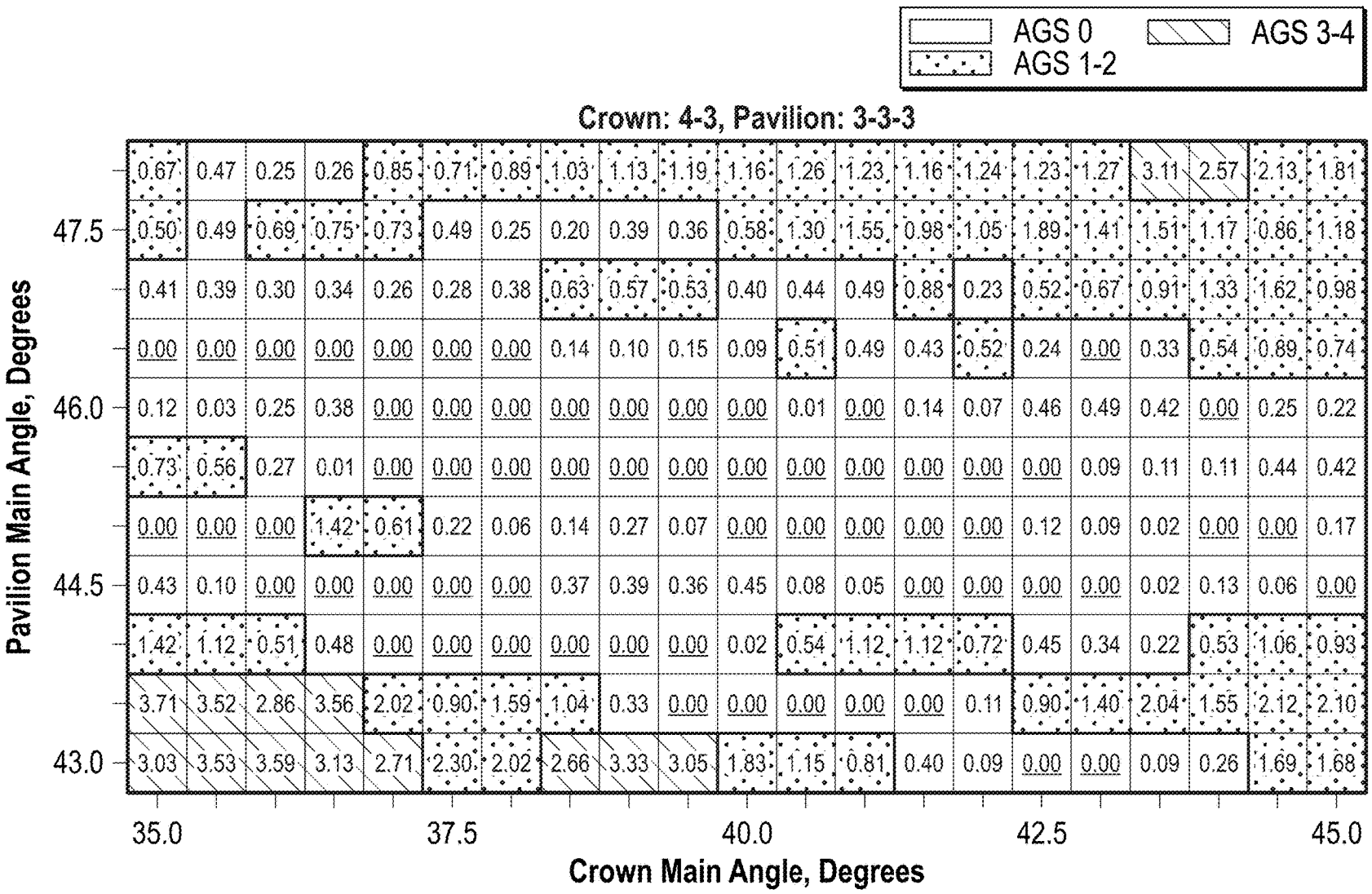
FIG. 13 is a map of the light performance grades of an emerald-cut diamond according to an embodiment of the present invention for a diamond with L/W ratio 1.35, corner ratio 14%, a table % of 55, crown breaks of 4-3 and pavilion breaks of 3-3-3 (4-tier) over ranges of crown main angles of 35.0-45.0 and pavilion main angles of 43.0-48.0.

Light performance deductions were determined for virtual emerald-cut diamonds having a table % of 55, L/W ratio 1.35, corner ratio 14%, crown breaks of 4-3 and pavilion breaks of 3.3-3 (4-tier) over ranges of crown main angles of 35.0-45.0 degrees and pavilion main angles of 43.0-48.0 degrees. The light performance deductions are shown in the map of FIG. 13. The 0-grade domain density is 0.693. FIG. 3B is a side sectional view of an Example 6 diamond with a crown main angle of 40.0 degrees and a pavilion main angle of 45.0 degrees, which has 0.00 performance deductions (FIG. 13).

Example 7

Figure 14:
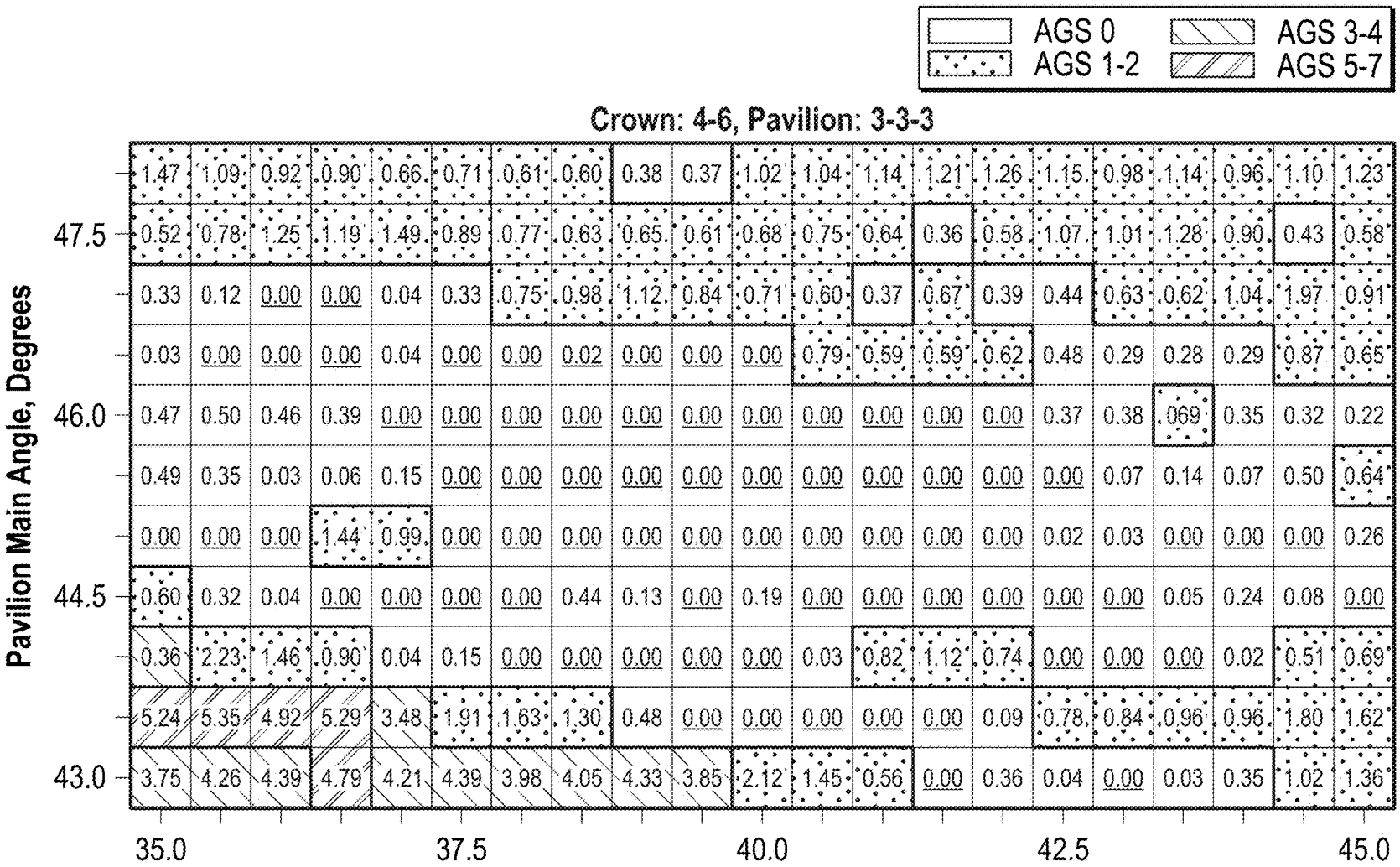
FIG. 14 is a map of the light performance grades of an emerald-cut diamond according to an embodiment of the present invention for a diamond with L/W ratio 1.35, corner ratio 14%, a table % of 55, crown breaks of 4-6 and pavilion breaks of 3-3-3 (4-tier) over ranges of crown main angles of 35.0-45.0 and pavilion main angles of 43.0-48.0.

Light performance deductions were determined for virtual emerald-cut diamonds having a table % of 55, L/W ratio 1.35, corner ratio 14%, crown breaks of 4-6 and pavilion breaks of 3-3-3 (4-tier) over ranges of crown main angles of 35.0-45.0 degrees and pavilion main angles of 43.0-48.0 degrees. The light performance deductions are shown in the map of FIG. 14. The 0-grade domain density is 0.571.

Example 8

Figure 15:
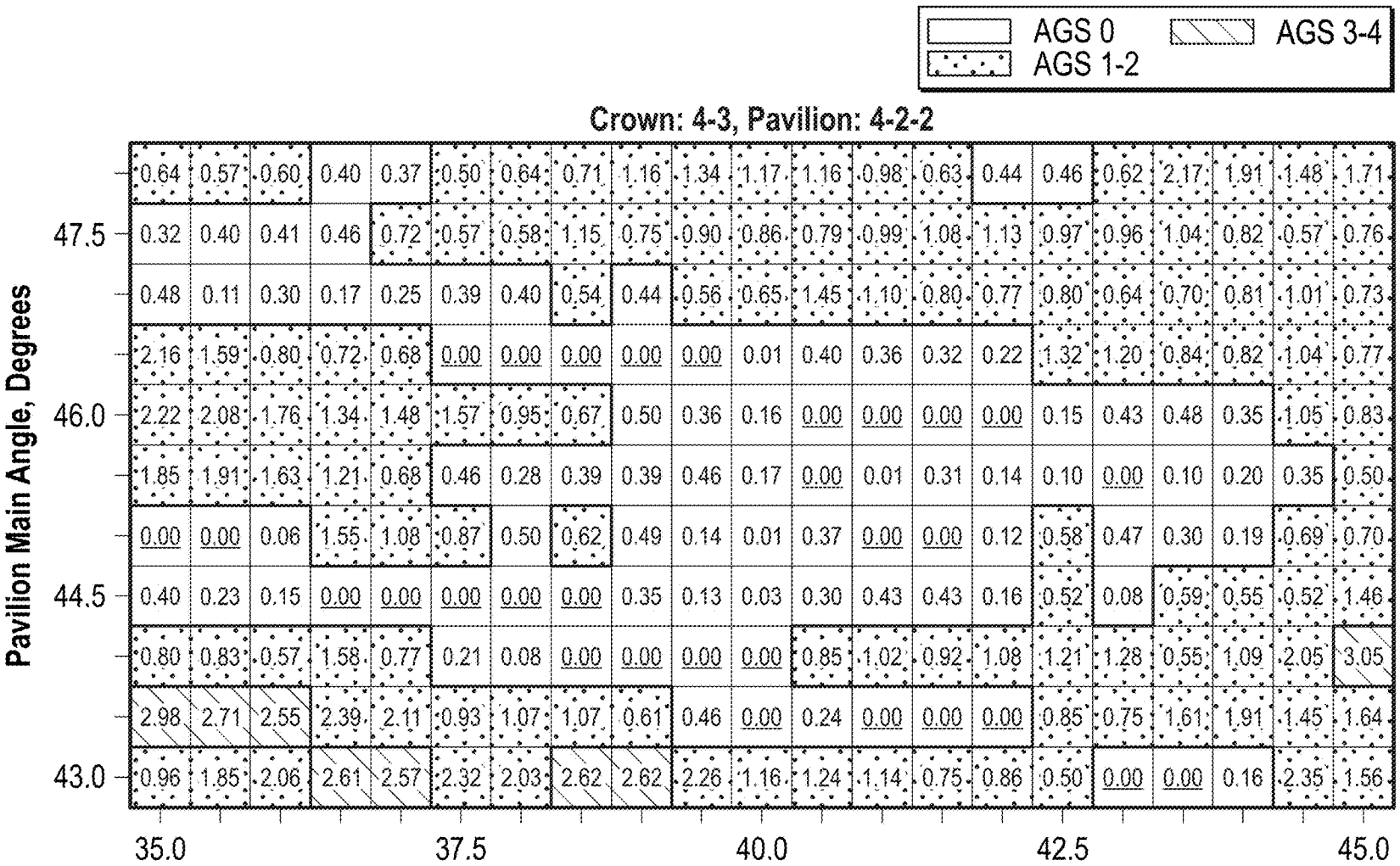
FIG. 15 is a map of the light performance grades of an emerald-cut diamond according to an embodiment of the present invention for a diamond with L/W ratio 1.35, corner ratio 14%, a table % of 55, crown breaks of 4-3 and pavilion breaks of 4-2-2 (4-tier) over ranges of crown main angles of 35.0-45.0 and pavilion main angles of 43.0-48.0.

Light performance deductions were determined for virtual emerald-cut diamonds having a table % of 55, L/W ratio 1.35, corner ratio 14%, crown breaks of 4-3 and pavilion breaks of 4-2-2 (4-tier) over ranges of crown main angles of 35.0-45.0 degrees and pavilion main angles of 43.0-48.0 degrees. The light performance deductions are shown in the map of FIG. 15. The 0-grade domain density is 0.420.

As seen in Table 2 below, the 0-grade domain areas are unexpectedly more extensive than in the published guidelines, with higher densities of the 0-grade domains.

TABLE 2

0-Grade Domain Density Comparison

| FIG. | Pavilion Tiers | L/W | Corner Ratio | Table % | Crown Breaks | Pavilion Breaks | 0-Grade Domain Density |
|---|---|---|---|---|---|---|---|
| 4 (Prior art) | 3 | 1.40 | 0.14 | 55 | 5.5-2.5 | 11.5-4.5 | 0.156 |
| 6 (Prior art) | 3 | 1.40 | 0.14 | 55 | 7-7 | 11-7 | 0.051 |
| 7 (Prior art) | 3 | 1.40 | 0.14 | 60 | 7-7 | 11-7 | 0.077 |
| 8A | 3 | 1.35 | 0.14 | 55 | 4-3 | 3-4 | 0.411 |
| 9A | 3 | 1.35 | 0.14 | 55 | 4-3 | 3-5 | 0.472 |
| 10A | 3 | 1.35 | 0.14 | 55 | 4-3 | 4-5 | 0.450 |
| 11A | 3 | 1.35 | 0.14 | 55 | 4-3 | 5-4 | 0.441 |
| 12A | 3 | 1.35 | 0.14 | 55 | 4-3 | 5-5 | 0.372 |
| 13 | 4 | 1.35 | 0.14 | 55 | 4-3 | 3-3-3 | 0.693 |
| 14 | 4 | 1.35 | 0.14 | 55 | 4-6 | 3-3-3 | 0.571 |
| 15 | 4 | 1.35 | 0.14 | 55 | 4-3 | 4-2-2 | 0.420 |

Although only a few example embodiments have been described in detail above, those skilled in the art will readily appreciate that many modifications are possible in the example embodiments without materially departing from this invention. Accordingly, all such modifications are intended to be included within the scope of this invention as defined in the following claims. It is the express intention of the applicant not to invoke 35 U.S.C. § 112(f) for any limitations of any of the claims herein, except for those in which the claim expressly uses the words 'means for' together with an associated function and without any recitation of structure.

What I claim is:

1. An emerald-cut diamond, comprising:

a. a ratio of length to width, measured at a girdle between a crown and a pavilion, of from 1.325 to 1.425;

b. corners;

c. a table having a width of from 54.5 to 60.5 percent of the girdle width;

d. a girdle thickness of up to 3.5 percent of the girdle width;

e. a crown main facet tier adjacent the girdle having an angle with respect to the table plane of from 27.75 to 45.25 degrees;

f. a crown second tier adjacent to crown main tier having a first crown break angle between the crown main tier and the crown second tier from 1.5 to 6.5 degrees;

g. a crown third tier adjacent the crown second tier having a second crow n break angle between the crown second tier and the crown third tier from 1.5 to 6.5 degrees;

h. a pavilion main facet tier adjacent the girdle having an angle with respect to the table plane of from 42.75 to 48.25 degrees;

i. a pavilion second tier adjacent the pavilion main tier having a first pavilion break angle between the pavilion main tier and the pavilion second tier from 1.5 to 6.5 degrees; and j. a pavilion third tier adjacent the pavilion main tier having a second pavilion break angle between the pavilion second tier and the pavilion third tier from 1.5 to 6.5 degrees;

k. wherein the diamond exhibits an AGS light performance grade of 1 or 0.

2. The emerald-cut diamond of claim 1, further comprising an AGS light performance grade of 0.

3. The emerald-cut diamond of claim 1, further comprising light performance deductions less than 0.20.

4. The emerald-cut diamond of claim 1, wherein the pavilion third tier terminates at a culet.

5. The emerald-cut diamond of claim 1, further comprising a pavilion fourth tier adjacent the pavilion third tier having a third pavilion break angle between the pavilion third tier and the pavilion fourth tier from 1.5 to 5.5 degrees.

6. The emerald-cut diamond of claim 5, wherein the pavilion fourth tier terminates at a culet.

7. The emerald-cut of claim 6, wherein the first pavilion break angle is from 1.5 to 4.5 degrees, wherein the second pavilion break angle is from 1.5 to 4.5 degrees, wherein the third pavilion break angle is from 1.5 to 4.5 degrees, and wherein an AGS light performance grade is 0.

8. The emerald-cut diamond of claim 1, wherein the first and second crown break angles are 3.5-4.5 and 2.5-3.5 degrees, respectively.

9. The emerald-cut diamond of claim 8, wherein the crown main angle is from 34.75 to 45.25 degrees.

10. The emerald-cut diamond of claim 9, wherein the first and second pavilion break angles are from 2.5 to 5.5 degrees.

11. The emerald-cut diamond of claim 9, wherein the first pavilion break angle is 2.5-3.5 degrees, wherein the second pavilion break angle is 3.5-4.5 or 4.5-5.5 degrees, wherein the pavilion main angle is from 42.75 to 46.75 degrees, and wherein a light performance grade is 0.

12. The emerald-cut diamond of claim 9, wherein the first and second pavilion break angles are 4.5-5.5 and 3.5 4.5 degrees, respectively, wherein the pavilion main angle is from 43.25 to 48.25 degrees, and wherein a light performance grade is 0.

13. The emerald-cut diamond of claim 9, wherein the first and second pavilion break angles are each 4.5-5.5 degrees, wherein the pavilion main angle is from 44.25 to 48.25 degrees, and wherein a light performance grade is 0.

* * * * *